US008282363B2

(12) United States Patent
Ohi et al.

(10) Patent No.: US 8,282,363 B2
(45) Date of Patent: Oct. 9, 2012

(54) PORTABLE AIR COMPRESSOR

(75) Inventors: Taku Ohi, Greer, SC (US); Jesse Jerabek, Anderson, SC (US); Kenneth M. Brazell, Piedmont, SC (US); William E. Sadkowski, Anderson, SC (US); Richard L. Strack, Anderson, SC (US); Douglas Ritterling, Chesterfield, MO (US)

(73) Assignee: Techtronic Power Tools Technology Limited, Tortola (VG)

( * ) Notice: Subject to any disclaimer, the term of this patent is extended or adjusted under 35 U.S.C. 154(b) by 340 days.

(21) Appl. No.: 12/775,941

(22) Filed: May 7, 2010

(65) Prior Publication Data

US 2010/0290929 A1 Nov. 18, 2010

Related U.S. Application Data

(63) Continuation-in-part of application No. 12/060,952, filed on Apr. 2, 2008, now Pat. No. 7,887,303.

(60) Provisional application No. 61/176,798, filed on May 8, 2009, provisional application No. 60/909,836, filed on Apr. 3, 2007.

(51) Int. Cl.

| | |
|---|---|
| ***F04B 53/00*** | (2006.01) |
| ***F04B 19/00*** | (2006.01) |
| ***F04B 37/00*** | (2006.01) |
| ***F04B 17/03*** | (2006.01) |
| ***F04B 35/04*** | (2006.01) |

(52) U.S. Cl. ... 417/234; 417/238; 417/360; 417/423.15; 417/423.14

(58) Field of Classification Search ..... 417/234, 417/238, 360, 363, 423.7, 423.14, 423.15; 29/888.02

See application file for complete search history.

(56) References Cited

U.S. PATENT DOCUMENTS

| | | | | |
|---|---|---|---|---|
| 6,099,268 | A * | 8/2000 | Pressel | 417/360 |
| 6,296,459 | B1 * | 10/2001 | Saputo et al. | 417/423.14 |
| 6,375,437 | B1 | 4/2002 | Nolan | |
| 6,485,269 | B1 * | 11/2002 | Matthew et al. | 417/234 |
| 6,537,039 | B2 | 3/2003 | Mann | |
| 6,773,237 | B2 * | 8/2004 | Burford et al. | 417/234 |
| 2001/0005481 | A1 | 6/2001 | Mann | |
| 2001/0009646 | A1 * | 7/2001 | Leu et al. | 417/423.14 |
| 2002/0131872 | A1 | 9/2002 | Lucchi | |
| 2004/0028535 | A1 | 2/2004 | Brashears et al. | |
| 2005/0031458 | A1 * | 2/2005 | Brashears | 417/234 |
| 2006/0067836 | A1 | 3/2006 | Smith et al. | |
| 2008/0023100 | A1 | 1/2008 | Wonders | |
| 2008/0181794 | A1 * | 7/2008 | Steinfels et al. | 417/234 |

OTHER PUBLICATIONS

International Search Report and Written Opinion from International Searching Authority for PCT/US2008/057972 dated Jul. 22, 2008 (11 pages).

* cited by examiner

*Primary Examiner* — Devon Kramer
*Assistant Examiner* — Bryan Lettman
(74) *Attorney, Agent, or Firm* — Michael Best & Friedrich LLP

(57) ABSTRACT

An air compressor includes a compressor unit having a motor with a motor housing, a pump operably coupled to the motor and having a pump housing formed as a single piece with a portion of the motor housing, and a first tank fluidly connected to the pump to receive pressurized air from the pump when operated by the motor. The air compressor also includes a tank unit removably coupled to the compressor unit in a stacked arrangement. The tank unit includes a second tank fluidly connected to the pump to receive pressurized air from the pump when operated by the motor.

16 Claims, 18 Drawing Sheets

1000a
1000
1003
1002
61
27
20
50c
20c
20b
50
54
230
210
50b
50a
W
u
20a
X
Z

PORTABLE AIR COMPRESSOR

CROSS-REFERENCE TO RELATED APPLICATIONS

This application claims priority to U.S. Provisional Patent Application No. 61/176,798 filed on May 8, 2009, the entire content of which is incorporated herein by reference.

This application is also a continuation-in-part of co-pending U.S. patent application No. Ser. 12/060,952 filed on Apr. 2, 2008, which claims priority to U.S. Provisional Patent Application No. 60/909,836 filed Apr. 3, 2007, the entire contents of both of which are incorporated herein by reference.

FIELD OF THE INVENTION

The present invention relates to air compressors, and more particularly to portable air compressors.

BACKGROUND OF THE INVENTION

Air compressors are typically used to provide compressed air for operating pneumatic tools such as nailing tools, socket-driving tools, materials-shaping tools, sanding tools, and the like. Often, because of various constraints including size, weight, and available sources of electrical power to operate the air compressor, air compressors are typically remotely located from the accompanying pneumatic tools using the compressed air generated by the compressors. As a result, a hose having a substantial length is often required to connect the air compressor to the pneumatic tool. Using long stretches or lengths of hose typically yields an undesirably high pressure differential between the outlet of the air compressor and the pneumatic tool which, in turn, typically reduces the efficiency and performance of the pneumatic tool.

Another consequence of using pneumatic tools at a remote distance from a stationary air compressor is that a user of the air compressor often cannot quickly and conveniently adjust the output of the air compressor when switching between pneumatic tools requiring different regulated inlet pressures. Rather, users must often discontinue their work and go to the air compressor to change the regulated output pressure of the compressor according to the requirements of the particular pneumatic tool they are about to use. Walking to the air compressor, and then back to the worksite reduces the efficiency of the user of the pneumatic tool, which ultimately may result in increased costs associated with the construction at the worksite.

SUMMARY OF THE INVENTION

The present invention provides, in one aspect, an air compressor including a compressor unit having a motor with a motor housing, a pump operably coupled to the motor and having a pump housing formed as a single piece with a portion of the motor housing, and a first tank fluidly connected to the pump to receive pressurized air from the pump when operated by the motor. The air compressor also includes a tank unit removably coupled to the compressor unit in a stacked arrangement. The tank unit includes a second tank fluidly connected to the pump to receive pressurized air from the pump when operated by the motor.

The present invention provides, in another aspect, an air compressor including a compressor unit having a motor, a pump operably coupled to the motor, and a first tank coaxial with the motor and the pump. The first tank is fluidly connected to the pump to receive pressurized air from the pump when operated by the motor. The air compressor also includes a tank unit removably coupled to the compressor unit in a stacked arrangement. The tank unit includes a second tank fluidly connected to the pump to receive pressurized air from the pump when operated by the motor.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 2:
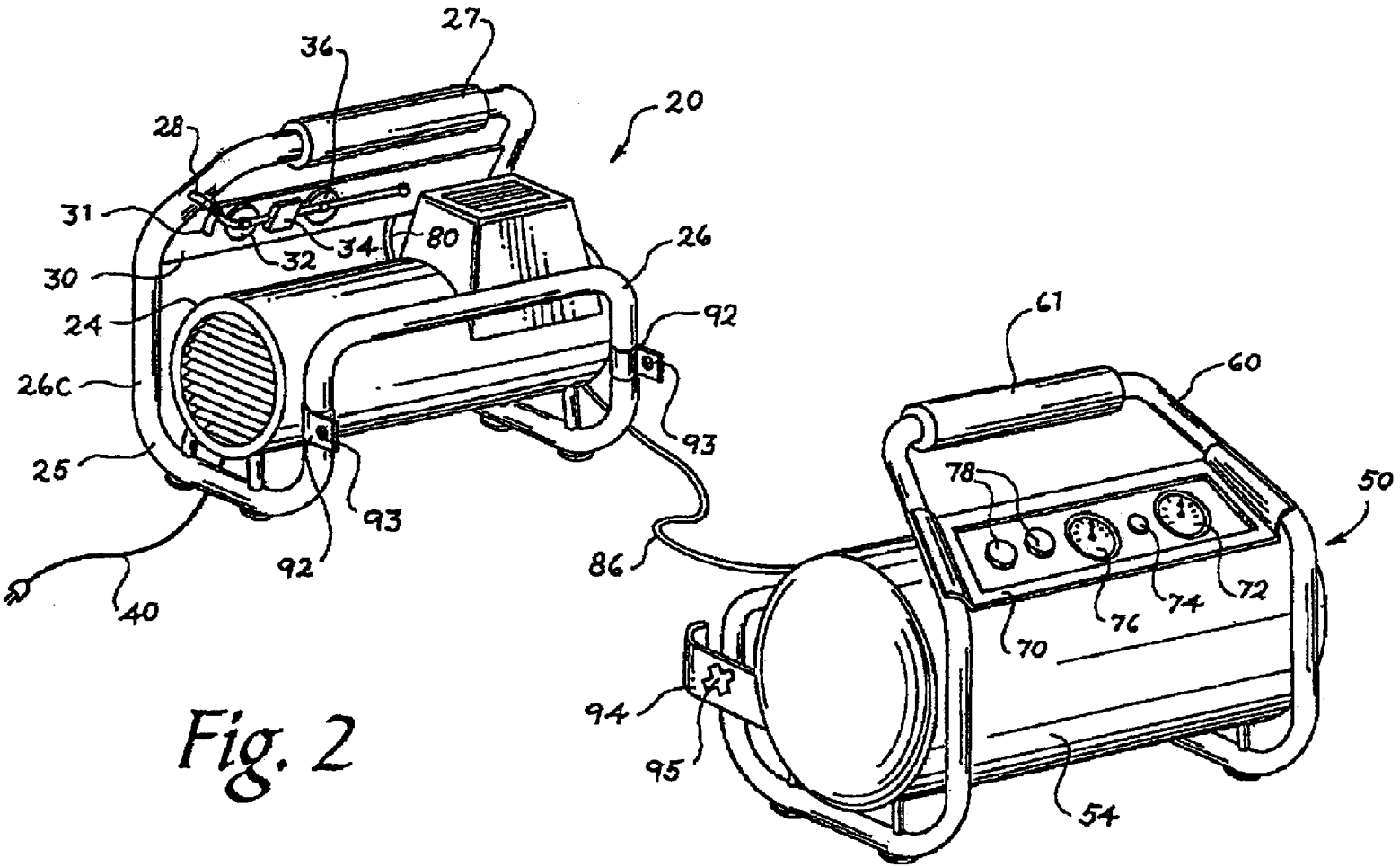
FIG. 2 is a perspective view of the air compressor of FIG. 1, illustrating the pump unit and the tank unit mechanically separated, but not fluidly separated.
Figure 3:
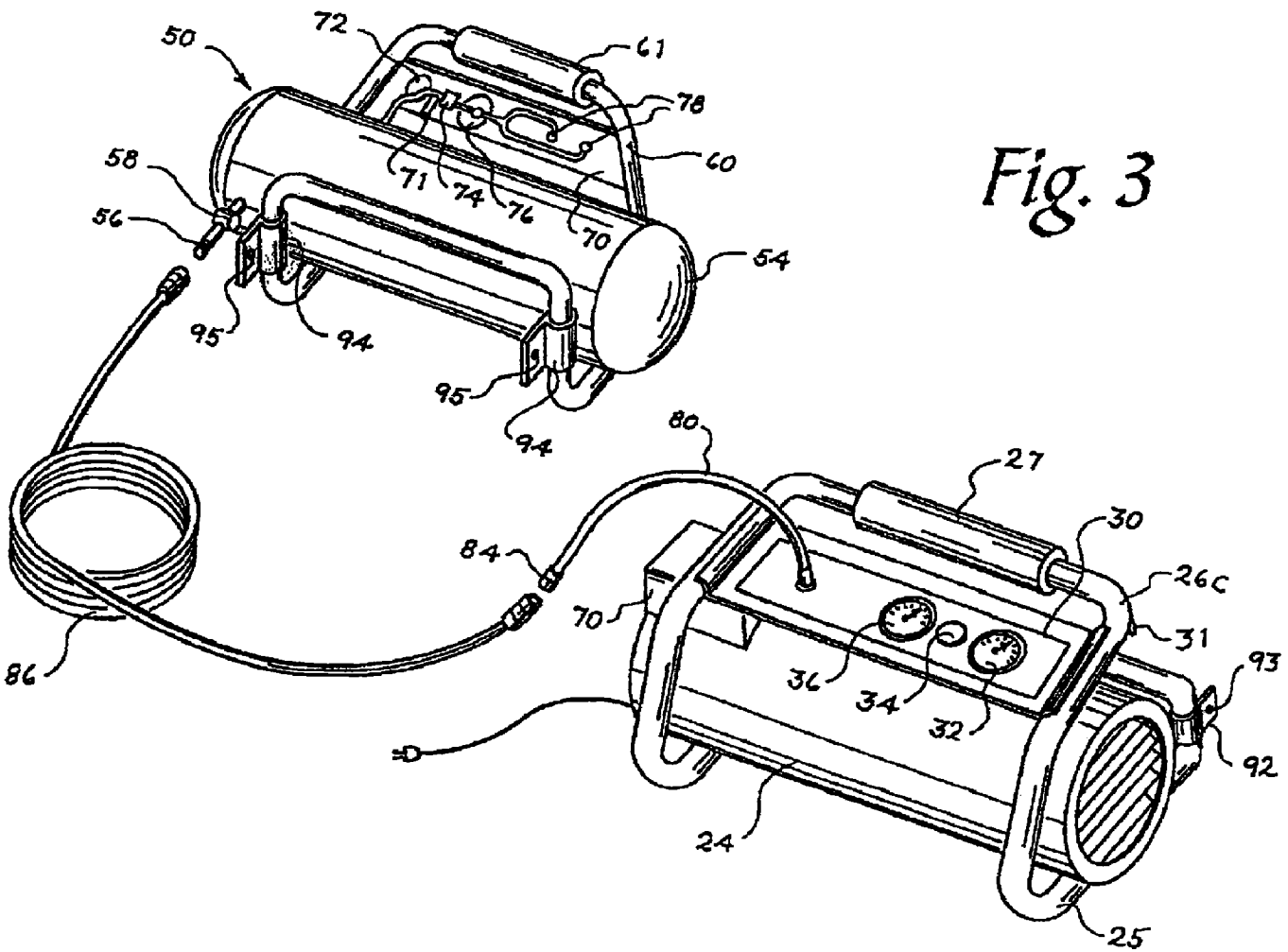
FIG. 3 is a reverse perspective view of the air compressor of FIG. 2, illustrating the pump unit and the tank unit mechanically separated and fluidly separated.
Figure 8:
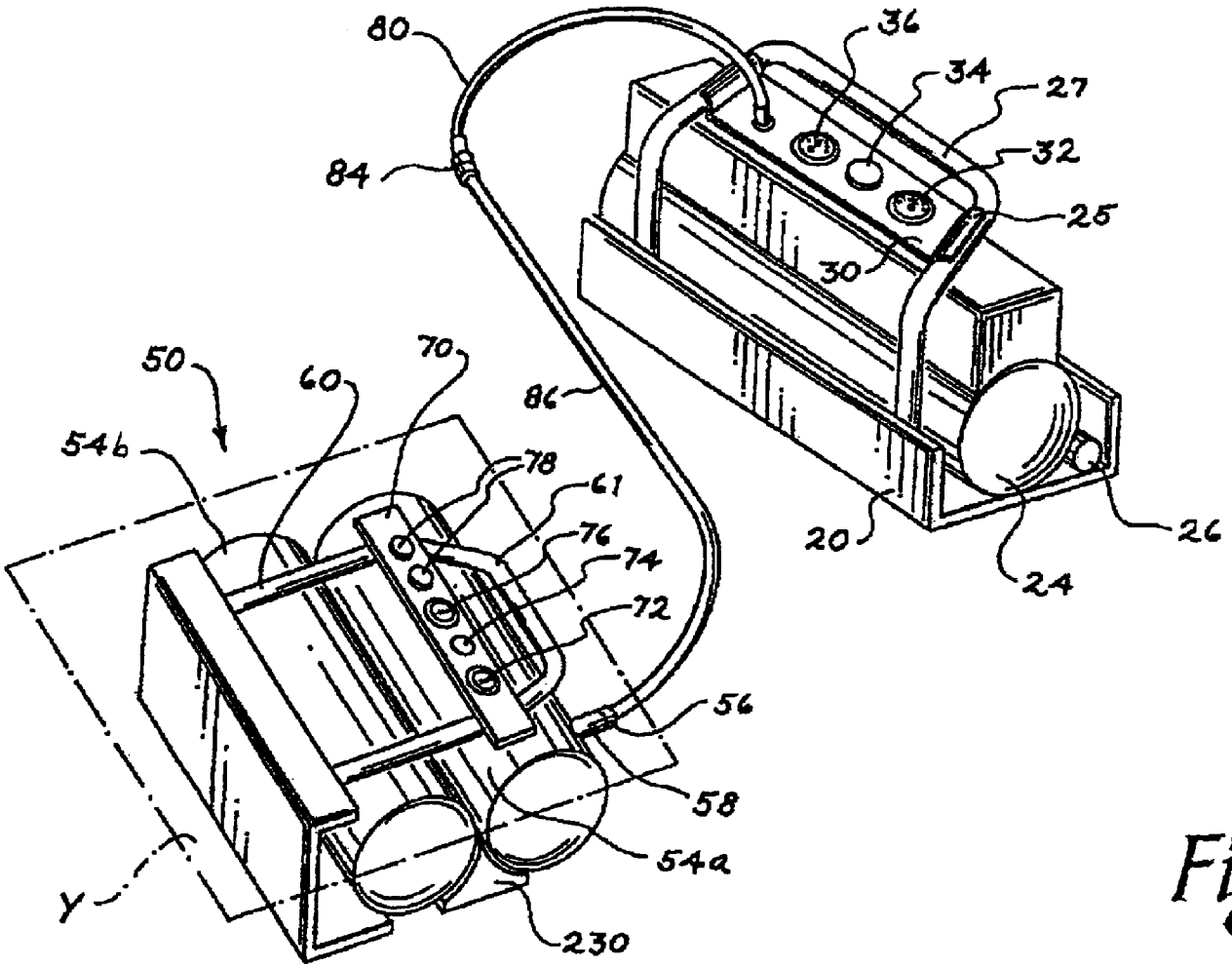
FIG. 8 is a perspective view of the air compressor of FIG. 4, illustrating the pump unit and the tank unit positioned remotely from each other.

Turning now to the figures, an air compressor 10 is provided. The air compressor 10 includes an electrically driven air pump 24, a power cord 40 connectable with a source of electrical current, a first air tank 26 fluidly connected to the pump 24, a second tank 54, a removable flow path between the first tank 26 and the second tank 54, a pressure regulator 74, a tank pressure gauge 72, and an output connection 78. The air compressor 10 includes two units, the pump unit 20 and the tank unit 50. The air compressor 10 may be operated with the pump and tank units 20, 50 attached (FIGS. 1 and 5) or separated (FIGS. 2, 3, and 8). The air compressor 10 may also be operated with only the pump unit 20 to provide a source of air. Further, the tank unit 50 may be used alone to provide a source of compressed air without fluid connection with the tank unit 20.

The pump unit 20 may operate as a stand alone air compressor. The pump unit 20 is powered from a source of electrical power, such as batteries or by AC current delivered to the pump unit 20 by an electrical cord. The pump unit 20 may additionally include a first air tank 26 that is provided downstream of the air pump 24 to store a volume of compressed air. The first tank 26 may include one or more of a "hot dog" style tank 26*a* (FIG. 4-10) or it may include an air tank 26*c* defined within the internal volume of the frame 25, or roll-cage that surrounds the majority of the tank unit 20 (FIG. 1-4). Alternatively, the first tank 26 may be one or more "pancake" style tanks (not shown) or another geometrical shaped tank that is suitable for the pump unit 20. The first tank 26 also may include an output port 28 which is fluidly connected to a pump manifold 30. The pump 20 is surrounded and supported by the roll cage frame 25.

The air pump 24 may be automatically operated to maintain air pressure within the first tank 26 within a predetermined pressure range. The pump unit 20 includes a pressure switch (not shown) provided in fluid communication with the first tank 26 to operate a contact or similar electrical component to selectively allow current to flow to the air pump 24 when the pressure switch senses first tank 26 pressure below the specified pressure within the pressure range and selectively prevents current flow to the pump 24 when the pressure switch senses pressure above a specified pressure within the pressure range. Pressure switches that operate in this manner are well known in the art and further description is not necessary.

In a representative embodiment, the pressure switch shuts (energizing the air pump 24) when it senses pressure at 90 psi or less and opens (securing the air pump 24) when it senses pressure at 150 psi. In other embodiments, different set points may be used. Further, other embodiments allow the user to manually adjust the setpoints of the pressure switch to control the cycling of the air pump 24. In further embodiments, a second or alternate pressure switch may be fluidly connected to the second tank 54 (discussed below) and selectively electrically connectable with the air pump 24 to allow the air pump 24 to cyclically operate to maintain pressure within the second tank 54 within a predetermined or adjustable range.

A pump manifold 30 is fluidly connected to an output 28 of the first tank 26 such that compressed air exiting the first tank 26 flows through the pump manifold 30. The pump manifold 30 may include a first tank pressure gauge 32, a pressure regulator 34 with an associated pressure gauge 36, an output hose 80, and a relief valve 31 upstream of the pressure regulator 34. Alternatively, the relief valve 31 may be provided on the first tank 26. The operation of the pump manifold 30, with the associated pressure regulator 34, and relief valve 31 is well known in the art. The output hose 80, or whip hose, may be mechanically connected to the first manifold 30 on a first end, and include a universal mating output connector 84 on an opposite extended end. In some embodiments, the output connector 84 may be a quick connect coupler (QC). Alternatively, other types of fluid connectors may be used. In situations where only the pump unit 20 is used, an air hose from a work tool (not shown) may be connected directly to the output connector 84 of the output hose 80. In this case, a worker may transport only the pump unit 20 to the job site when only a small amount of compressed air is necessary to perform the job.

In another embodiment shown, the pump unit 20 may include an output connector located downstream of the pressure regulator 34 on the pump manifold 30. In this embodiment, any length of air hose may be connected to the output connector, or a hose of a work tool (not shown) may be directly connected to the output connector. In embodiments including an output connector, the manifold 30 includes an isolation valve such as a globe valve, gate valve, butterfly valve, etc., between the output connector and the pressure regulator 34 to prevent the compressed air from exiting the manifold 30 when no hose or tool is connected to the output connector.

The tank unit 50 includes a second tank 54, an inlet connector 56, a protective frame 60, a handle 61, and a tank manifold 70. In some embodiments, shown in FIGS. 4-9, the second tank 54 may be two or more air tanks 54*a* that are rigidly and fluidly connected together with an air flow path therebetween. The second tank 54 may be one or more "hot dog" style air tanks, one or more "pancake" style air tanks, or in other embodiments, the second tank 54 may be formed from various other shapes and geometries that are suitable for the use of the tank unit 50.

The inlet connector 56 provides a flow path for air to enter the second tank 54 from the pump unit 20. The inlet connector 56 may be a male quick connect coupler (QC) valve, but other types of connectors suitable for compressed gasses that are known in the art may be used. A check valve 58 may be provided between the second tank 54 and the inlet connector 56 to prevent the compressed air inside the second tank 54 from escaping to the atmosphere when the tank unit 50 is not connected to the pump unit 20. The check valve 58 allows compressed air at a higher pressure to enter the tank unit 50 through the inlet connector 56, but will prevent the flow of air from the second tank 54 in the reverse direction through the inlet connector 56. Any type of check valve that is suitable to prevent back flow of compressed gas may be used for the check valve 58. Alternatively, the check valve 58 may be replaced with an manually operable isolation valve (not shown) such as a gate valve, globe valve, butterfly valve, etc. to provide manual isolation for the second tank 54 in the tank unit 50.

The tank manifold 70 may be provided on the tank unit 50 and may include a tank pressure gauge 72, a pressure regulator 74 with an associated regulator pressure gauge 76, and one or more parallel output connectors 78 downstream of the pressure regulator 74. In some embodiments, female QC connectors are used for the output connectors 78, although other embodiments may use any type of fluid connectors that are suitable for removable connection with tools or devices using compressed gas for operation.

The regulator 74 may be operated to lower the pressure of air that flows through the output connectors 78 when connected to an output hose (not shown). The tank manifold 70 may further include a relief valve 71 that is set to lift at a pressure above the high end of the normal pressure range, but below the pressure rating of the second tank 54 to prevent a catastrophic failure of the second tank 54 due to an overpressure situation. Alternatively, the relief valve 71 may be directly attached to the second tank 54. The design and operation of relief valves that perform this function are well known in the art.

The pump unit 20 may be mechanically and fluidly connected to the tank unit 50. In this situation, the initial air flow path remains the same as discussed for the operation of only the pump unit 20, but the tank unit 50 is fluidly connected to the pump unit 20, through either the output connector of the pump unit manifold 30 or the output port 84 of the hose 80. Specifically, a hose 86 connects an output of the pump unit to the inlet connector 56 of the tank unit 50. In this situation, the first tank 26 is connected in series with the second tank 54 so that, in most situations, the pressure within the first tank 26 equalizes with the pressure in the second tank 54 after the two are connected (i.e. when the pressure in the first tank 26 is equal to or greater than the pressure in the second tank 54).

When operating the compressor 10 in this manner, the user normally fully backs opens the pump regulator 34, causing the pump regulator 34 to not control the air pressure flowing through the output connection, to allow the pressure within the first tank 26 and the second tank 54 to fully equalize. In addition to lowering the air pressure exiting the pump manifold 30, if the pump regulator 34 is maintained in operation when the second tank 54 is connected in series to the pump manifold 30, the pump regulator 34 limits the flow of air to the second tank 54, increasing the time required to equalize the pressure in the two tanks 26, 54 and limits the maximum pressure available in the second tank 54 to the pump regulator 34 setting.

As best shown in FIGS. 2 and 8, the pump unit 20 and the tank unit 50 can be operated remotely from each other. In this setup, a first end of an extension hose 86 is connected to the output of the pump manifold 30 and an opposite end of the extension hose 86 is connected to the input connector 56 on the tank unit 50. This allows the tank unit 50 to be physically remote from the pump unit 20, while remaining in fluid connection with the pump unit 20.

Figure 10:
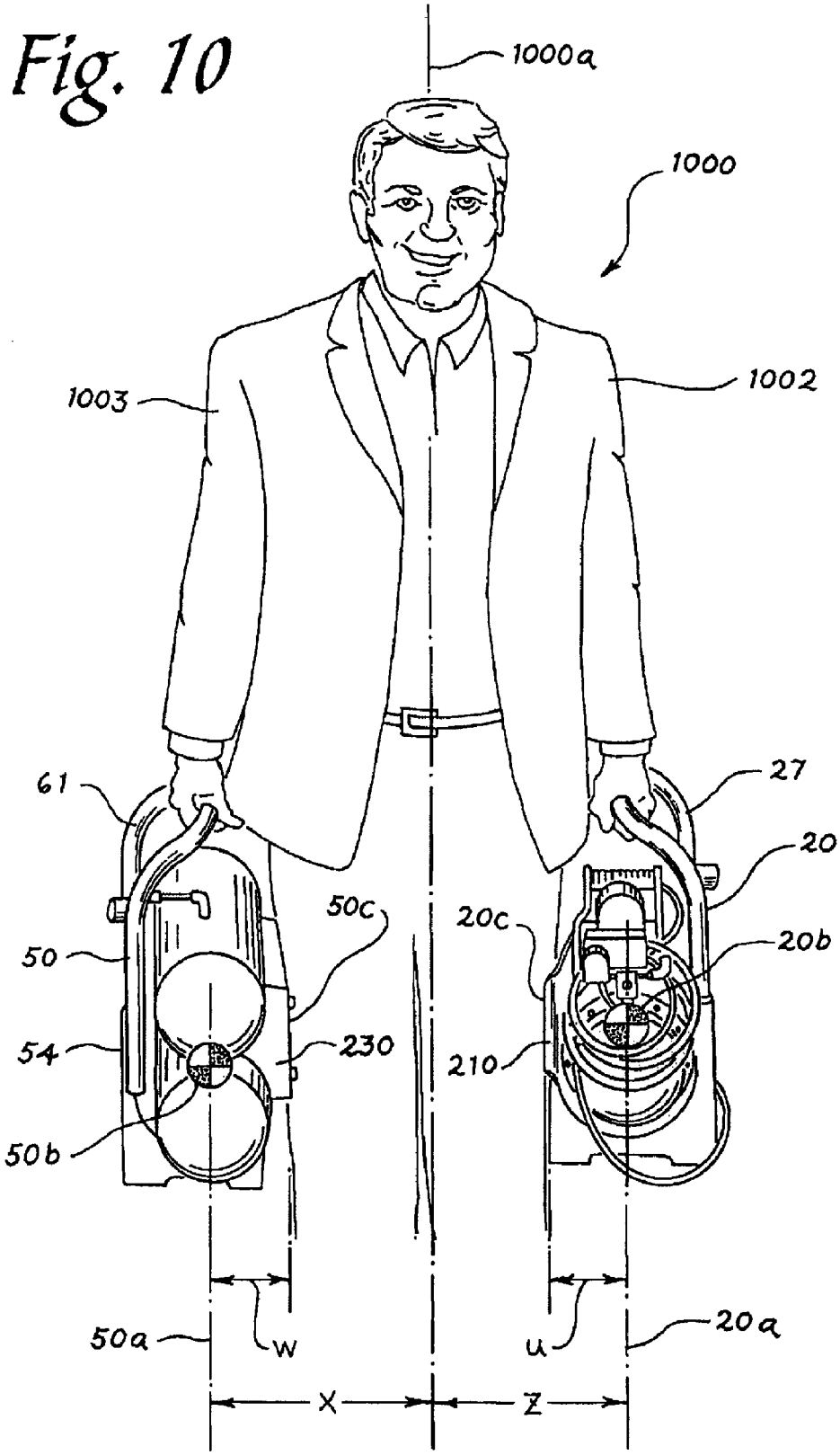
FIG. 10 is a front view of the air compressor of FIG. 4 mechanically disconnected and being carried on opposite sides of a user.

The pump and tank units 20, 50 can be mechanically and fluidly separated to allow the two units to be carried by the user on opposite hands on opposite sides of the user's body. Specifically, as best shown in FIG. 10, the pump and tank units 20, 50 may be carried by opposite hands and arms 1002, 1003 of the user 1000 and on opposite sides of the user's body at the same time. The user 1000 may carry the handle 27 of the pump unit 20 in a first hand 1002 and the handle 61 of the tank unit 50 in the opposite second hand 1003. In some embodiments the handles 27, 61 of each of the pump and tank units 20, 50, respectively, may be aligned substantially above and in a vertical plane 20*a*, 50*a*, with the center of gravity 20*b*, 50*b* of the respective pump and tank units 20, 50.

In this embodiment, the distance U, W between the center of gravity 20*b*, 50*b* and the side surface 20*c*, 50*c* of the respective pump and tank unit 20, 50 is minimized, which allows pump and tank units 20, 50 to be carried by the user 1000 while minimizing the distance Z, X between each center of gravity 20*b*, 50*b* of the respective pump and tank units 20, 50 and the centerline 1000*a* of the user 1000. This minimum distance Z, X allows the pump and tank units 20 to hang substantially straight downward from the user's 1000 hands and arms 1002, 1003, which limits the flex of the user's arms and wrists required to carry the two units 20, 50 of the air compressor 10 to provide for an ergonomic method for a user 1000 to carry the air compressor 10.

The minimum flex of the hands and arms 1002, 1003 allows the majority of the weight of the pump and tank units 20, 50 to be ultimately carried by the shoulders of the user 1000 and the remaining skeletal system of the user 1000, and not just by the respective hands and arms 1002, 1003. This orientation minimizes the amount of weight of the pump and tank units 20, 50 that must be carried by the hands and arms 1002, 1003, which is known to put localized strain and stress on the user's arm and hand muscles and increase the effort required to carry or hold the air compressor 10.

Each of the pump and tank units 20, 50 may be manufactured to be substantially the same weight to increase the user's 1000 ease of carrying the pump and tank units 20, 50 in opposite hands and arms 1002, 1003 as shown in FIG. 10. In some embodiments, each of the pump and tank units 20, 50 may be about 35 to 40 pounds. In other embodiments, the pump and tank units 20, 50 may be other weights that can be carried by the average user 1000 in opposite hands and arms 1002, 1003 on opposite sides of the user's 1000 body. In some embodiments, the pump and tank units 20, 50 are substantially the same weight such that the two units are less than five pounds different weights, on other embodiments, the pump and tank units 20, 50 are less than 10 pounds different weights. Because the pump and tank units 20, 50 may be substantially the same weight, the user may carry the units 20, 50 in opposite hands 1002, 1003 and maintain substantial upright balance due to a substantially even weight distribution between the respective right and left hands and arms 1002, 1003 while standing or while walking Further, each of the pump and tank units 20, 50 may be formed to be substantially the same size and shape, to further provide for ergonomic and upright balanced carrying of the mechanically separated or detached air compressor 10, which further increases the user's right to left balance while carrying the air compressor 10 when standing or walking.

Figure 1:
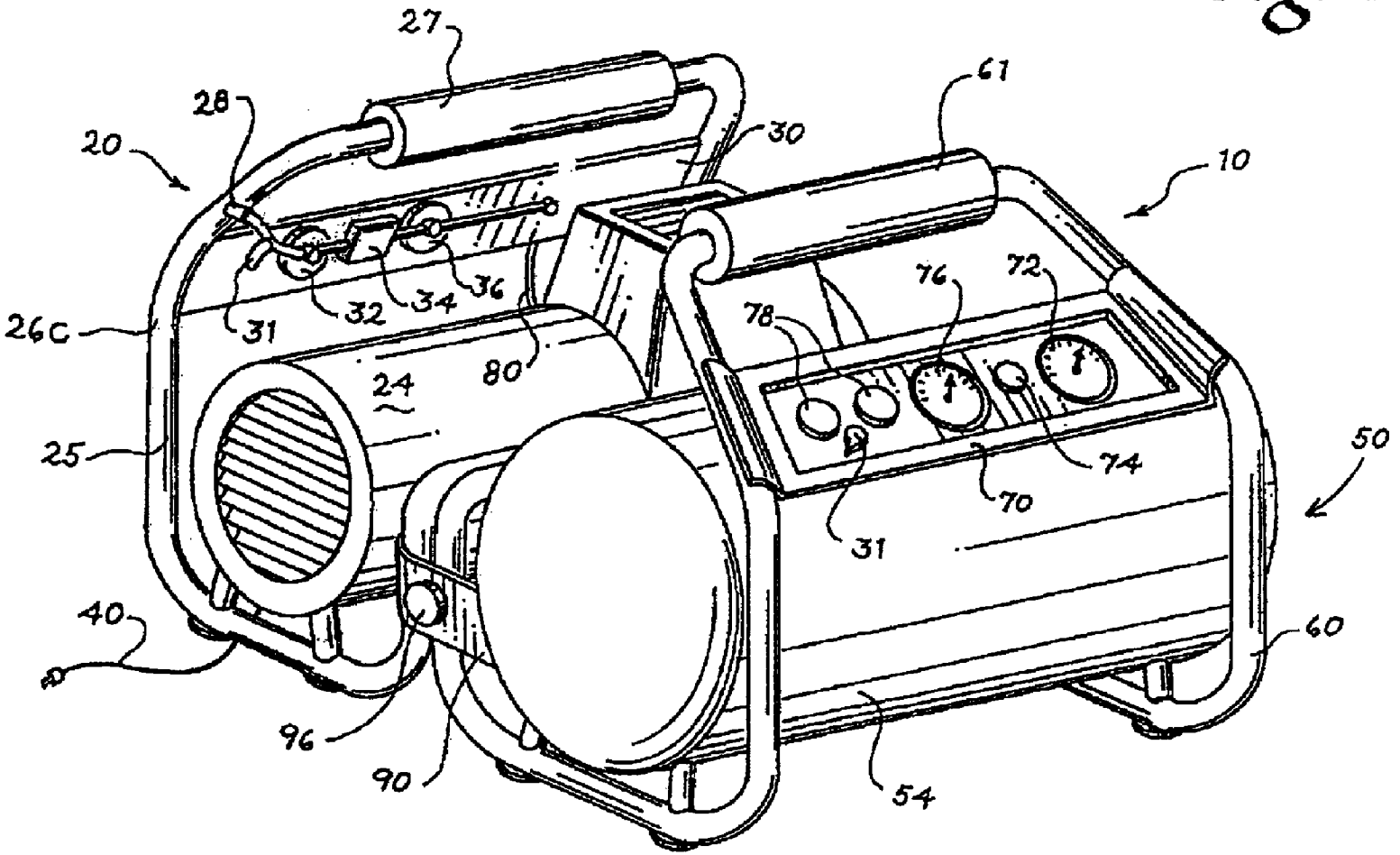
FIG. 1 is a perspective view of an air compressor of the invention, illustrating a pump unit and a tank unit mechanically connected.

As is shown in FIG. 1, the frames 25, 60 of the pump unit 20 and the tank unit 50, respectively, can be mechanically connected such that a user can carry both units together, with the user holding the handle 27 of the pump unit 20 in one hand and holding the handle 61 of the tank unit 50 in the other hand.

As shown in FIGS. 1-3, the pump unit frame 25 may be removably mechanically attachable to a tank unit frame 60 of the tank unit 50 using a bracket 90. The bracket 90 includes a leaf 92 with an aperture 93 on the pump frame 25 and a leaf 94 with an aperture 95 on the tank unit tank frame 60 with a fastener 96 used to removably connect the two leaves 92, 94. In the embodiments shown in FIGS. 1-3, the pump unit 20 and the tank unit 50 may be removably attached with two brackets 90 on opposite sides of the frames 26, 60. In other embodiments, the two units 20, 50 can be connected with only one bracket, which may be on a side of the air tank 50 opposite the inlet connector 56.

Figure 4:
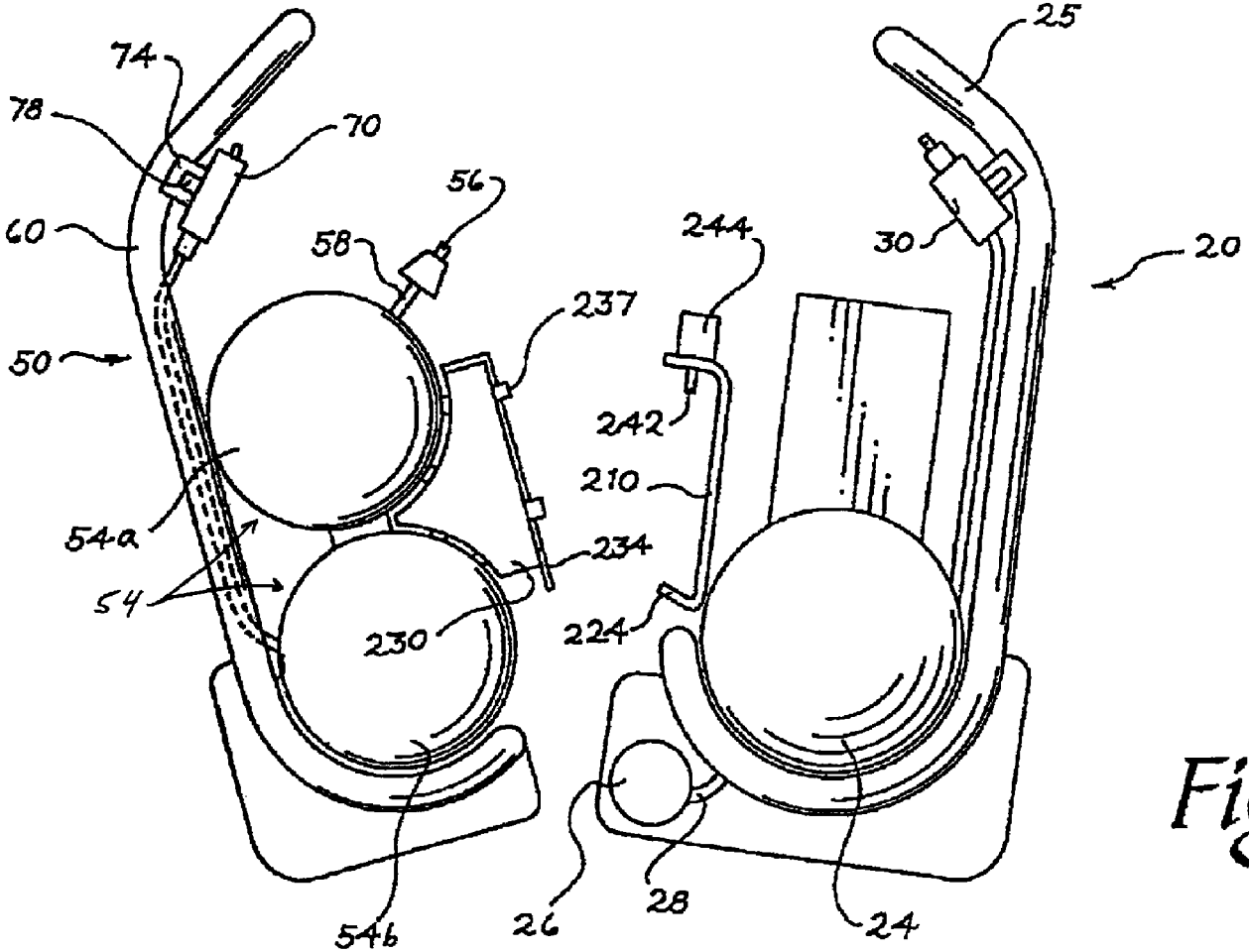
FIG. 4 is a side view of an air compressor according to another embodiment of the invention, illustrating a pump unit and a tank unit mechanically disconnected.
Figure 5:
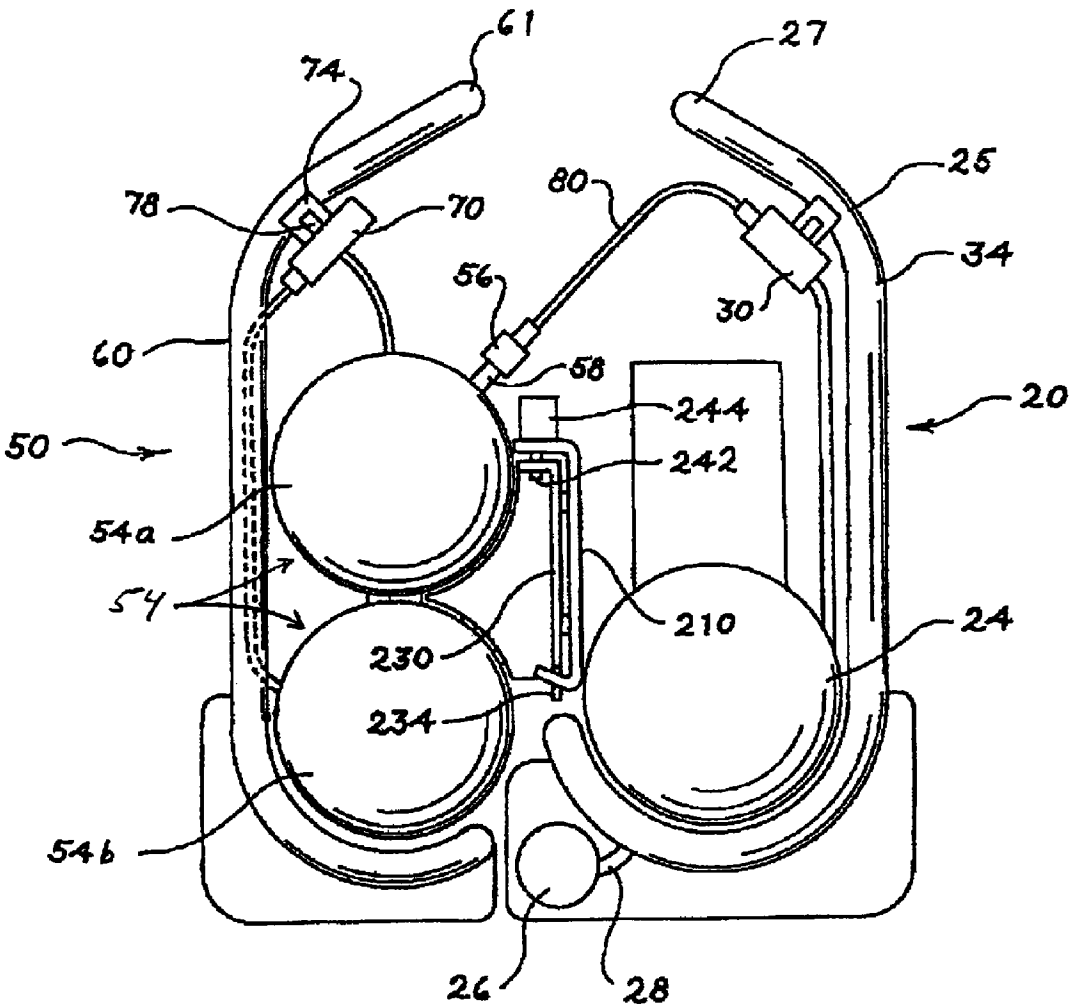
FIG. 5 is a side view of the air compressor of FIG. 4, illustrating the pump unit and the tank unit mechanically connected.
Figure 6:
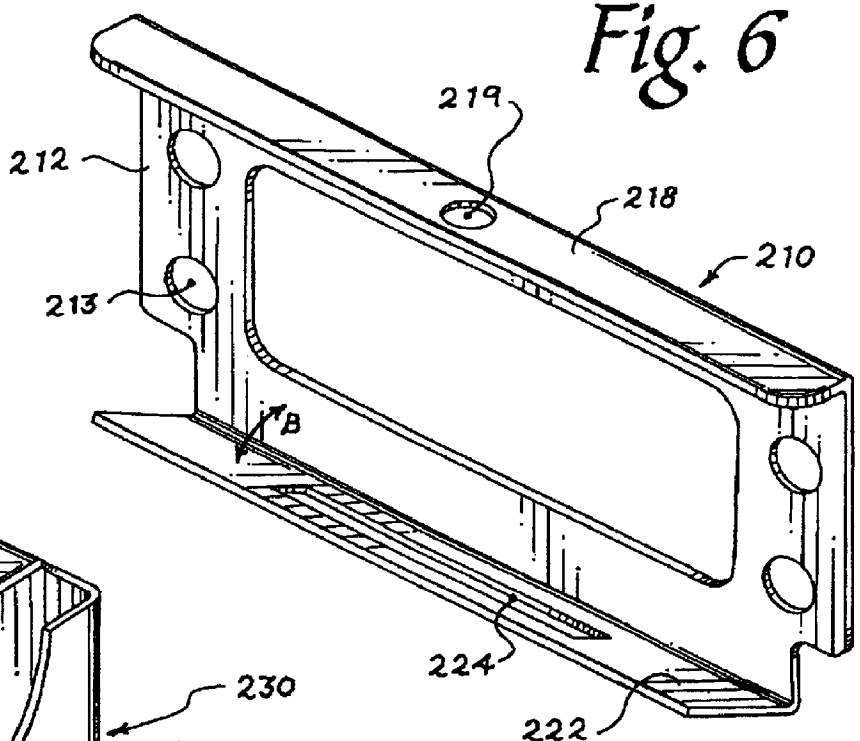
FIG. 6 is a perspective view of a pump unit plate of the air compressor of FIG. 4.

As shown in FIGS. 4-9, in an alternate embodiment, the pump unit frame 25 and the tank unit frame 60 may be removably mechanically attachable with a pair of engageable plates, the pump unit and tank unit plates 210, 230, respectively. The pump unit plate 210 is fixed to the pump unit 20 and may have a cross-section shaped substantially like a channel iron. As best shown in FIG. 6, the pump unit plate 210 includes a vertical surface 212 that is mounted to either the pump unit frame 25, the air pump 24 and the first tank 26, or to other suitable surfaces of the pump unit 20 such that the vertical surface is substantially vertical when the pump and tank units 20, 50 are mechanically connected together.

As best shown in FIGS. 4 and 6, the pump unit plate 210 further includes a top flange 218 that may extend substantially perpendicular to the vertical surface 212. The top flange 218 includes an aperture 219 that receives a pin 242 mounted to a biasing member 244 (FIGS. 4-5), which is mounted to a top surface of the top flange 218. The pin 242 of the biasing member 244 normally extends through the aperture 219, while the biasing member 244 can be pulled upward away from the top flange 218 against the biasing force of a spring (not shown) within the biasing member 244, until the pin 242 no longer extends through the top flange 218. The engagement between the pin 242 and the aperture 239 of the tank unit plate 230 (discussed below) is a first independent mechanical connection between the tank and pump units 20, 50.

The pump unit plate 210 further includes a bottom flange 222 that is provided on an opposite edge of the vertical surface 212 from the top flange 218. The bottom flange 222 may extend from the vertical surface at an acute angle .beta. from the vertical surface 212. In some embodiments, the angle .beta. may be between 45 and 85 degrees. In other embodiments, the angle .beta. may be between 50 and 65 degrees. In still other embodiments, the angle may be about 58 degrees or another angle within the ranges above. In other embodiments, the angle .beta. may be other angles suitable to allow for connection between the pump unit plate 210 and the tank unit plate 230. The bottom flange 222 includes a slot 224 that is formed to selectively receive a tooth 234 defined on the tank unit plate 230, discussed below.

Figure 7:
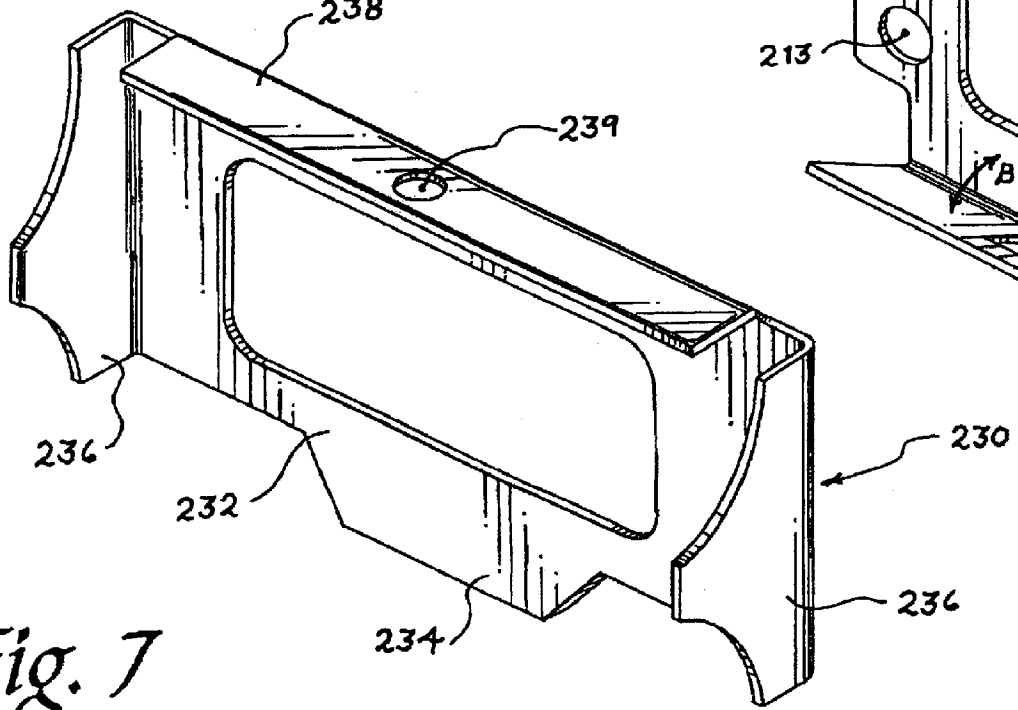
FIG. 7 is a perspective view of a tank unit plate of the air compressor of FIG. 4.

As best shown in FIGS. 5 and 7, the tank unit plate 230 is rigidly mounted to the tank unit 50 such the tank unit plate 230 has a vertical surface 232 that is mounted to the tank unit 50 to be substantially parallel to the vertical surface 212 of the pump unit plate 210 when the pump and tank units 20, 50 are mechanically connected together. As shown in FIGS. 4-7, the tank unit plate 230 may be rigidly mounted to the one or more second tanks 54 with suitable flanges 236 extending substantially perpendicularly from the vertical surface 232.

The tank unit plate 230 further includes a top flange 238 that extends inwardly toward the second tank 54 and substantially perpendicular to the vertical surface 232. The top flange 238 includes an aperture 239 that is coaxial with the aperture 219 on the pump unit plate 210, such that the aperture 239 on the tank unit plate 230 receives the pin 242 from the biasing member 244, which provides a portion of the mechanical connection between the pump and tank units 20, 50.

The tank unit plate 230 further includes a tooth 234 that extends from the vertical surface 232. The tooth 234 may be received within the slot 224 in the pump unit plate 210 to provide a second independent mechanical connection between the tank and pump units 20, 50.

In some embodiments, the tank unit plate 230 may include a plurality of feet 237 (FIGS. 4 and 9) that extend away from the air tank 54. The feet 237 may be received within a similar plurality of holes 213 defined in the pump unit plate 210 when the two plates 210, 230 are joined, to provide for an additional mechanical connection between the two units. Further, the feet 237 additionally provide a surface for contacting the floor or ground when the tank unit 50 is separated from the pump unit 20. Specifically, as shown in FIG. 8, the tank unit 50 normally is positioned in a horizontal orientation when not connected to the pump unit 20, such that a plane Y through the centers of the multiple second tanks 54*a* is substantially parallel with the ground, allowing the feet 237 to contact the ground.

In some embodiments, a rubber or other sufficiently flexible material may be provided on one of or both of the pump and tank unit plates 210, 230 in an orientation to contact the opposite pump and tank unit plate 210, 230 when the two are engaged. As shown schematically in FIG. 9, the rubber of other flexible material 231 is provided as a sheet on the tank unit plate 230 to contact the opposing surface of the pump unit plate 210. The rubber or other flexible material is provided to attenuate or reduce the transfer of vibrations created in one of the pump or tank units 20, 50 from being transferred to the other of the pump and tank units 20, 50. The rubber or other flexible material may be deposited on one or both of the pump and tank unit plates 210, 230 either in selected discrete locations or in other embodiments, the rubber or other flexible material may be deposited as a sheet on the surface of one or both of the pump and tank unit plates 210, 230 that all or substantially all of the contact between the two plates is through the rubber or other flexible surface.

In some embodiments, each of the pin 242 movable on the biasing member 244, the feet 237, the holes 213 receiving the feet 237, the tooth 234, and the slot 224 can be provided in a manner opposite of the pump and tank unit plates 210, 230 than discussed above. For example, in some embodiments, the biasing member 244 and the pin 242 may be provided on the top flange 238 of the tank unit plate 230 and extendable through the aperture 219 on the pump unit plate 210.

FIG. 4 provides a side view of the pump and tank units 20, 50 just prior to establishing the connection between the pump and tank unit plates 210, 230. Initially, the pump and tank units 20, 50 are placed with their respective plates 210, 230 positioned substantially parallel and in the vicinity of each other. Each of the pump and tank units 20, 50 are rotated away from each other, which raises the tooth 234 of the vertical surface 232 until the tooth 234 can be inserted into the slot 224 in the pump unit plate 210. Next, the pump and tank units 20, 50 are rotated toward each other, until the vertical surfaces 212, 232 of the plates are close to contacting each other. Finally, the biasing member 244 is pulled away from the top flange 218 of the pump unit plate 210, which allows the two apertures 219, 239 of the plates to align coaxially. The biasing member 244 is released and the pin 242 extends through the apertures 219, 239 in both of the plates 210, 230. In embodiments with feet 237 provided on the tank unit plate 230, the feet 237 extend through respective holes 213 in the pump unit plate 210. The pump and tank units 20, 50 can be mechanically disconnected by withdrawing the pin 242 from the tank unit plate 230 and rotating the two units away from each other to remove the tooth 234 from the slot 224.

In operation, as best shown in FIGS. 2-3 and 8, the pump and tank units 20, 50 may be operated remotely from each other. In this orientation, a first end of an air hose 86 of a suitable length may be connected to the output of the pump manifold 30 with a second end of the air hose 86 connected to the inlet connector 56 of the tank unit 50. Varying lengths of the air hose 86 may be used based on the desired distance between the pump and tank units 20, 50, but the system will have a higher pressure drop, or pressure lag, between the two units 20, 50 when longer hoses 86 are used. In this orientation, the user fully opens the pump regulator 34 so that the output pressure of the pump unit 20 is maintained at the pressure of the first tank 26. The operator adjusts the tank regulator 74 to adjust the output pressure from the tank manifold 70. In this orientation the tool is connected to one of the output connectors 78 on the tank manifold 70.

The air compressor 10 is operated similarly when the units 20, 50 are apart from each other as it operates when the units are connected by the bracket 90 (FIGS. 1-3) or the pump and the tank unit plates 210, 230 (FIGS. 4-9). When the air compressor 10 is provided with electrical power, the pump 24 cyclically runs to maintain the air pressure in the first tank 26 within the set pressure band. When the pressure switch (normally fluidly connected to the first tank 26) senses that the monitored pressure is at or below the low end of the band, the pump 24 energizes. When the monitored pressure reaches the high end of the pressure band, the air pump 24 secures and the monitored pressure decreases as air is withdrawn from the system for use.

In additional embodiments, the user may connect multiple tank units 50 in series to increase the air capacity of the system. In order to connect additional tank units 50, the user connects an air hose to one of the output ports 78 with the other end of the air hose to the inlet connection 56 on the second tank unit 50. Preferably, the user fully backs off the tank regulator 74 on the first tank unit 50 and controls pressure with the tank regulator 74 on the second tank unit 50, which is where the user connects their work tool. It is also possible to maintain the first tank regulator in operation in order to connect a tool to the manifold of the first tank unit 50 and connect a tool to the manifold 70 of a second tank unit 50 as well. In this orientation, the first tank regulator 74 may have difficulty maintaining the desired air pressure in the second tank unit 50 if it is heavily cycled because the first tank regulator 74 limits the flow of air from the first tank unit 50 to the second tank unit 50, which may be less than the amount of air that is drawn off of the second tank unit 50 by the user.

Figure 9:
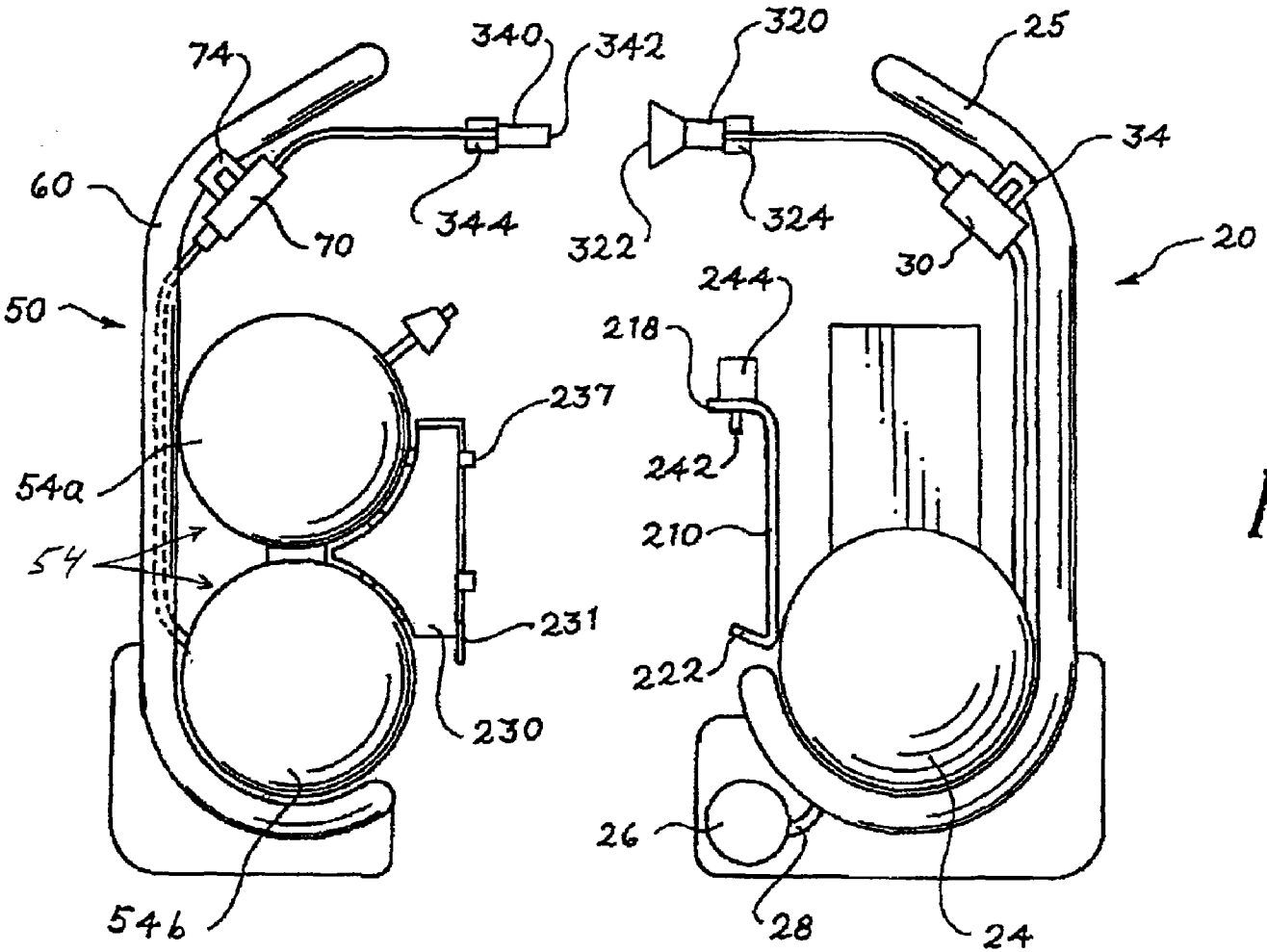
FIG. 9 is a side view of an air compressor according to another embodiment of the invention, illustrating a pump unit and a tank unit mechanically and fluidly disconnected.

In an alternate embodiment shown in FIG. 9, the pump and tank units 20, 50 may be fluidly connected using an automatic connection system. The automatic connection system fluidly connects the two units 20, 50 whenever the two units are mechanically connected, with either the pump and tank unit plates 210, 230, the bracket 90, or with any other type of suitable mechanical connection. The outlet of the pump manifold 30 includes a female connector 320 fluidly connected downstream of the pump regulator 34. The female connector 320 is sized to fluidly receive a corresponding male connector 340 that is fluidly connected to the second tank 54.

As the pump and tank units 20, 50 are rotated or otherwise moved toward each other to interlock the plates 210, 230, the bracket 90, or other similar mechanical connection structure, the male connector 340 of the tank unit 50 is inserted within a cone-like distal end 322 of the female connector 320, which aligns a distal end 342 of the male connector 340 to make a tight fluid seal with the female connector 320. The male and female connectors 320, 340 are removable from fluid connection when the pump and tank units are rotated or moved. In some embodiments, each of the male and female connectors 320, 340 include isolation valves 324, 344 upstream of the respective connector to provide for fluid isolation of the respective unit when the two are not fluidly connected.

Figure 11:
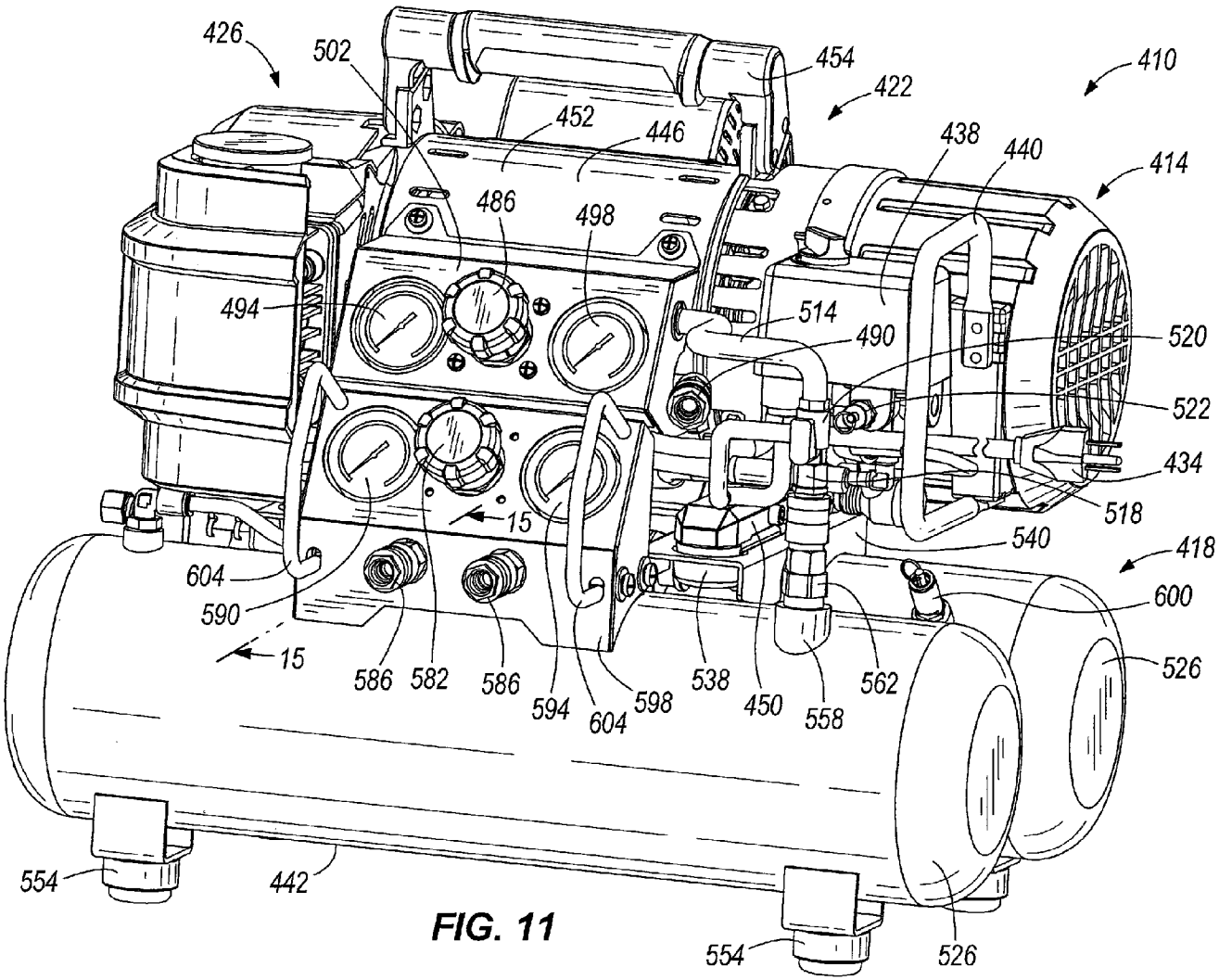
FIG. 11 is a front perspective view of an air compressor according to another embodiment of the invention, illustrating a pump unit and a tank unit mechanically and fluidly connected.

FIG. 11 illustrates a portable air compressor 410 according to another embodiment of the invention, including a pump or compressor unit 414 removably coupled to a tank unit 418 in a stacked arrangement. In the illustrated construction of the air compressor 410, the compressor unit 414 is stacked on top of the tank unit 418, such that the weight of the compressor unit 414 is supported by the tank unit 418. Alternatively, the air compressor 410 may be configured such that the tank unit 418 is stacked on top of the compressor unit 414, such that the weight of the tank unit 418 is supported by the compressor unit 414. Stacking the compressor unit 414 and the tank unit 418 in this manner allows both of the units 414, 418 to perform a supporting or weight-carrying function, which otherwise would be performed by separate frames for each of the units 414, 418. Specifically, the compressor unit 414 carries the weight of the tank unit 418 when stacked and carried as a unit, while the tank unit 418 supports the weight of the compressor unit 414 when stacked and sitting stationary on a support surface as a unit. By eliminating the separate frames for each of the units 414, 418, the overall weight of the air compressor 410 may be reduced to facilitate hand-carrying of the air compressor 410.

Figure 13:
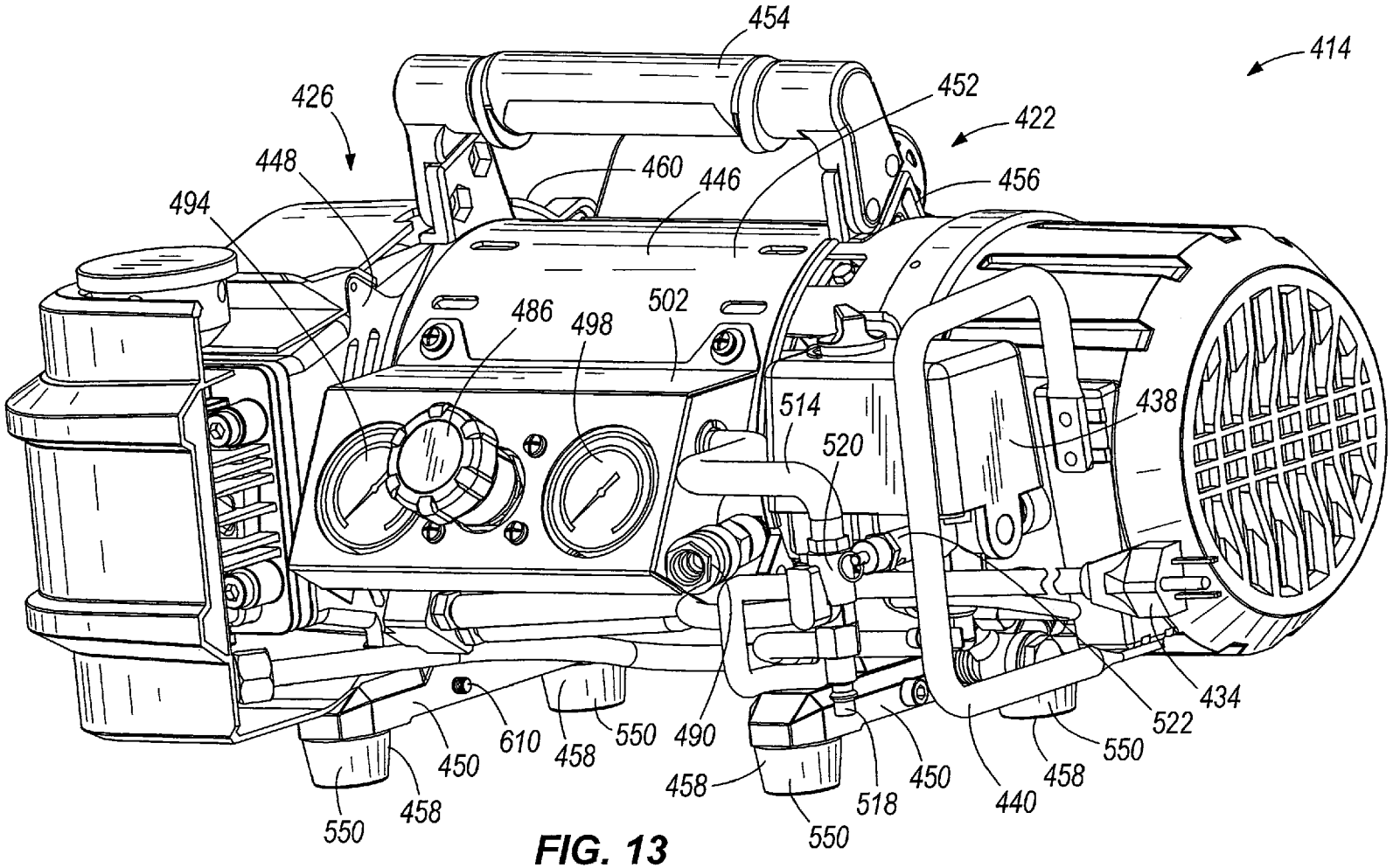
FIG. 13 is a front perspective view of the compressor unit of FIG. 11.
Figure 22:
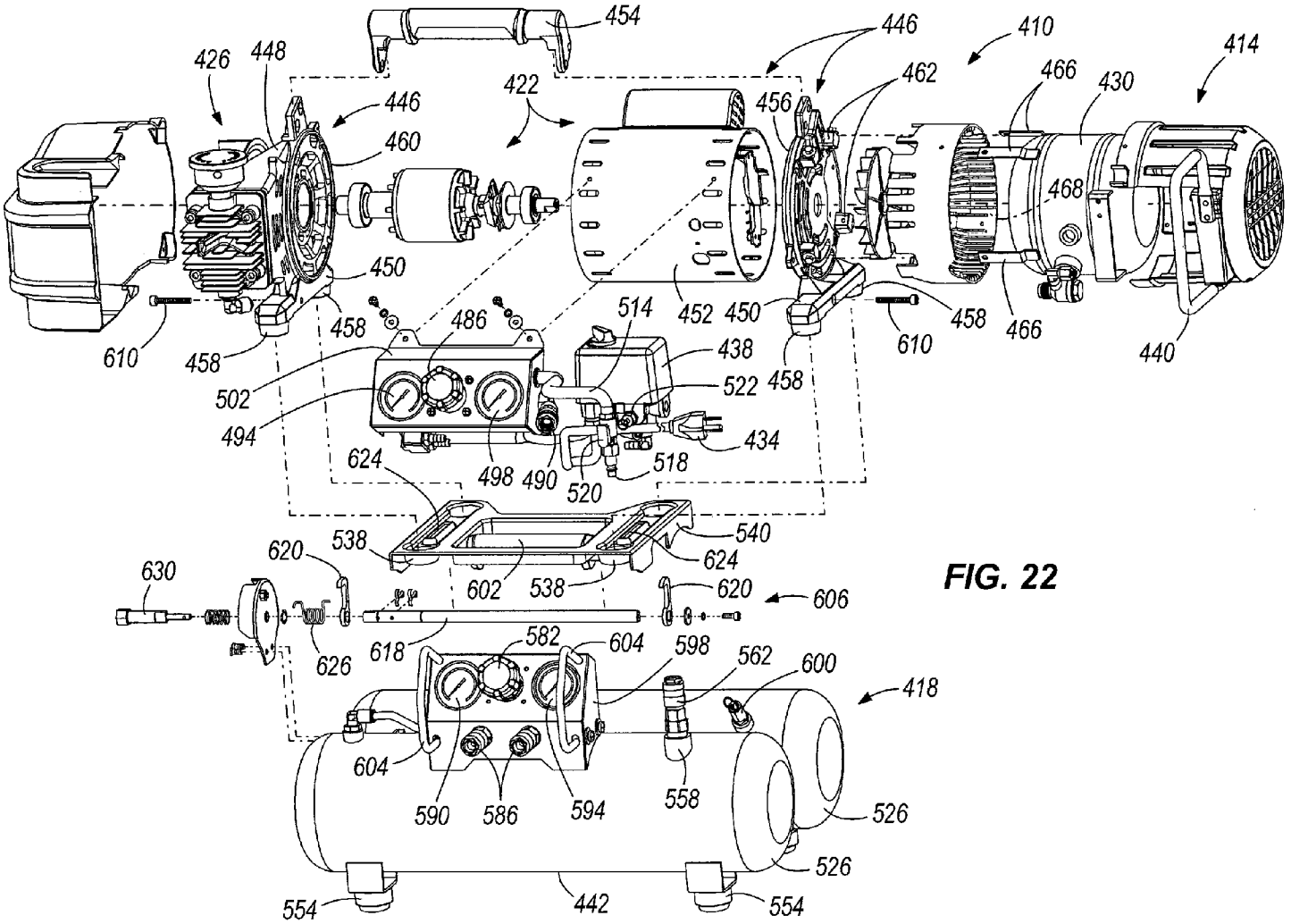
FIG. 22 is an exploded, front perspective view of the air compressor of FIG. 11.

With reference to FIGS. 13 and 22, the compressor unit 414 includes a motor 422, a pump 426 operably coupled to the motor 422 to receive torque from the motor 422, and a tank 430 (i.e., a "first tank"; FIG. 22) fluidly connected to the pump 426 to receive compressed or pressurized air from the pump 426 when operated by the motor 422. The motor 422 is an AC electric motor 422 that is selectively electrically connectable to a source of line current via a power cord 434 (e.g., household line current, current generated by a portable generator, etc.). Alternatively, the motor 422 may be configured as a DC electric motor that is powered by battery pack onboard or separate from the air compressor 410 (e.g., one or more power tool battery packs).

The compressor unit 414 also includes a switch 438 between the electric motor 422 and the source of line current (or the battery pack, in a battery-powered air compressor) to provide automatic on/off switching of the electric motor 422. In the illustrated construction of the air compressor 410, the switch 438 monitors the air pressure within the tank 430 to determine the operational state (i.e., on or off) of the electric motor 422. Specifically, should the air pressure within the tank 430 fall below a predetermined value, the switch 438 would close to electrically connect the motor 422 with the source of line current. Likewise, should the air pressure within the tank 430 reach or exceed the predetermined value, the switch 438 would open to electrically disconnect the motor 422 from the source of line current. The switch 438 is protected by a bar 440 that substantially surrounds at least a portion of the outer periphery of the switch 438 to protect the switch 438 should the air compressor 410 roll over or fall to the ground. In the illustrated construction of the air compressor 410, the bar 440 is coupled to the tank 30 (e.g., by fastening, etc.). Alternatively, the bar 658 may be coupled to the housing 446.

The pump 426 is a single piston, oil-less pump 426 that is capable of discharging compressed or pressurized air at a particular flow rate and pressure. The pump 426 is sized to maintain the tank 430 in the compressor unit 414 (and a tank 442 in the tank unit 418; discussed in more detail below) filled with pressurized air at a predetermined pressure, without requiring repeated on/off cycling of the motor 422 and the pump 426 while the air compressor 410 is being used. Alternatively, the pump 426 may be configured in any of a number of different ways (e.g., multi-piston, oil-fed, etc.).

With continued reference to FIGS. 13 and 22, the motor 422 and pump 426 are combined as a pump/motor unit, with the motor 422 including a motor housing 446 and the pump 426 including a pump housing 448 formed as a single piece with a portion of the motor housing 446. With reference to FIG. 22, the motor housing 446 includes a central drum 452 and opposed end caps 456, 460. Particularly, the pump housing 448 is formed as a single piece with the end cap 460. Although not shown, a plurality of fasteners are used to interconnect the drum 452 and the end caps 456, 460, such that the drum 452 is sandwiched between the end caps 456, 460.

With continued reference to FIG. 22, each of the end caps 456, 460 includes a leg 450 formed as a single piece therewith. As such, the legs 450 support the compressor unit 414 on a support surface (e.g., the ground or a work surface) or on the tank unit 418 when stacked on top of the tank unit 418, as shown in FIG. 11. Alternatively, the legs 450 may be configured as separate and distinct components that are coupled to the motor and/or pump housings 446, 448 using fasteners. An elastomeric foot or pad 458 is attached to the distal end of each of the legs 450 to reduce the amount of vibration transferred from the compressor unit 414 to the underlying support surface of the compressor unit 414 or the tank unit 418.

With reference to FIGS. 13 and 22, the compressor unit 414 further includes a handle 454 disposed near the top of the compressor unit 414 to facilitate hand-carrying the compressor unit 414 and the air compressor 410 when the compressor unit 414 and the tank unit 418 are attached as shown in FIG. 11. In the illustrated construction of the air compressor 410, the handle 454 is a separate and distinct component that is coupled to the motor housing 446 using fasteners. Alternatively, portions of the handle 454 may be formed as a single piece with the respective end caps 456, 460, or the handle 454 may be formed as a single piece with one of the end caps 456, 460.

Referring to FIG. 22, the tank 430 is coupled to the end cap 456 of the motor housing 446 in a substantially coaxial relationship using a plurality of overlapping or inter-engaging brackets or tabs 462, 466, respectively, and a plurality of fasteners (e.g., bolts) securing the tabs 466 to the respective tabs 462. Consequently, the tank 430 is substantially coaxial with the motor 422 and the pump 426 along a longitudinal axis 468 of the compressor unit 414. Alternatively, the tank 430 may be coupled to the housing 446 in any of a number of different ways and orientations.

Figure 12:
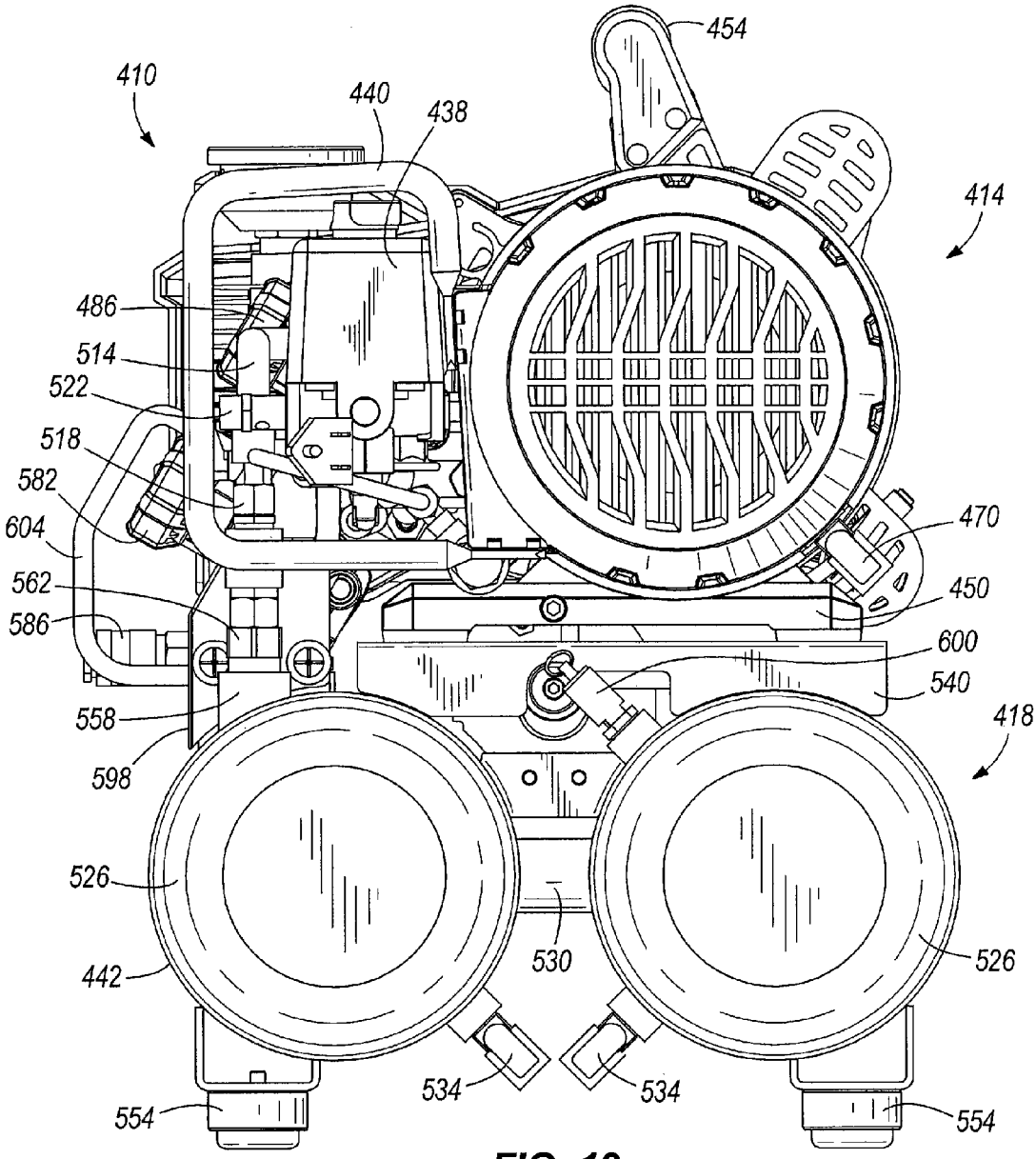
FIG. 12 is a side view of the air compressor of FIG. 11.

The tank 430 is sized having an internal volume of about one-half gallon (1.9 liters). As a result, the diameter or width of the tank 430 is substantially similar to that of the housing 446 to yield a substantially symmetrical and balanced shape of the housing 446 and tank 430 relative to the location of the handle 454 to facilitate hand-carrying the compressor unit 414. Alternatively, the tank 430 may be sized having an internal volume less than or greater than one-half gallon (1.9 liters). The compressor unit 414 also includes a drain valve 470 coupled to the tank 430 to facilitate draining any accumulated water in the tank 430 that condensed from the pressurized air in the tank 430 (FIG. 12). The drain valve 470 may be configured as a ball valve, a gate valve, and the like, and may be selectively opened and closed by the user of the air compressor 410 to drain accumulated water from the tank 430.

Figure 21:
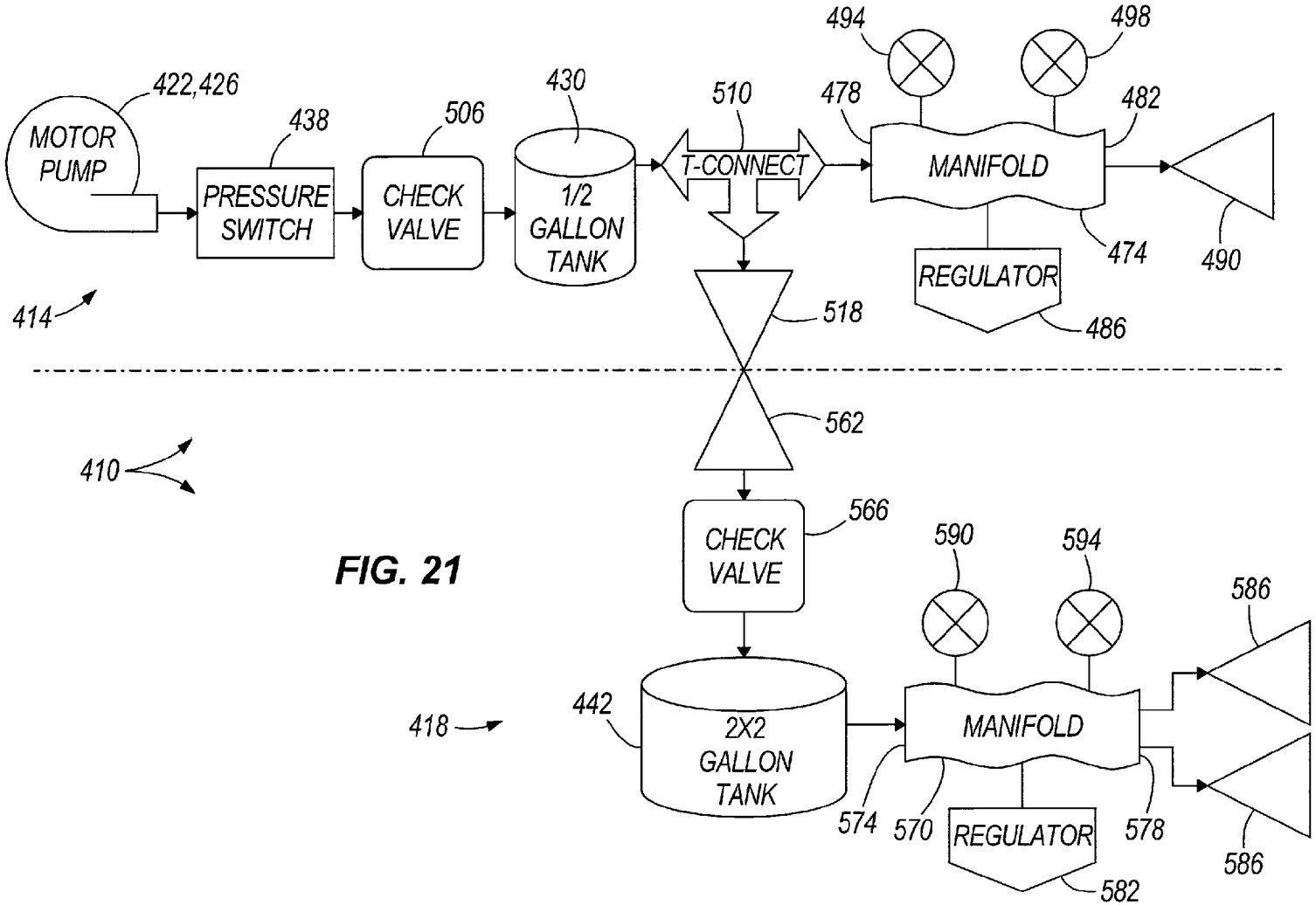
FIG. 21 is a schematic illustrating the components of the air compressor of FIG. 11.

With reference to FIGS. 21 and 22, the compressor unit 414 also includes a manifold 474 having an inlet 478, which is in fluid communication with the tank 430, and an outlet 482. The compressor unit 414 further includes a pressure regulator 486 coupled to the manifold 474 between the inlet 478 and the outlet 482. The pressure regulator 486 is adjustable by the user of the compressor unit 414 to restrict the flow of the pressurized air through the manifold 474 and set the output pressure that is available at the outlet 482. More particularly, the pressure regulator 486 may be adjusted between a full-open position, in which the pressure available at the manifold outlet 482 is substantially equal to the pressure in the tank 430, and a partially-opened position, in which the pressure available at the manifold outlet 482 is less than the pressure in the tank 430. As is described in greater detail below, users of the compressor unit 414 may adjust the pressure regulator 486 to set the output pressure available at the manifold outlet 482 according to the particular pneumatic tool being used.

With continued reference to FIGS. 21 and 22, the compressor unit 414 also includes a quick-disconnect fitting 490 fluidly connected to the outlet 482 of the manifold 474 to facilitate a quick connection with an air hose. In the illustrated construction of the compressor unit 414, the quick-disconnect fitting 490 is configured as a female quick-disconnect fitting 490 (FIG. 13). Alternatively, the quick-disconnect fitting 490 may be configured as a male quick-disconnect fitting.

With continued reference to FIG. 13, the compressor unit 414 also includes a pressure gauge 494 fluidly connected to the manifold 474 at a location upstream of the pressure regulator 486 and a pressure gauge 498 fluidly connected to the manifold 474 at a location downstream of the pressure regulator 486. Because the pressure gauge 494 is located upstream of the pressure regulator 486, the pressure gauge 494 (i.e., the "tank" gauge 494) detects the pressure in the tank 430, while the pressure gauge 498 (i.e., the "regulated pressure" gauge 498) located downstream of the pressure regulator 486 detects the available output pressure or regulated pressure at the manifold outlet 482 (FIG. 21). Users of the compressor unit 414 may view the tank gauge 494 to determine the air pressure in the tank 430, while the regulated pressure gauge 498 may be viewed by users of the compressor unit 414 when adjusting the pressure regulator 486. The compressor unit 414 includes a gauge panel 402 (FIG. 13) supporting the tank gauge 494, the regulated pressure gauge 498, and the pressure regulator 486. In the illustrated construction of the compressor unit 414, the gauge panel 402 is coupled to the housing 446 using a plurality of fasteners (e.g., screws, etc.). Alternatively, the gauge panel 402 may be coupled to the housing 446 in any of the number of different ways.

With reference to FIG. 21, the compressor unit 414 includes a one-way check valve 406 positioned between an outlet of the pump 426 and the tank 430 to inhibit reverse flow of the pressurized air in the tank 430 toward the pump 426 when the motor 422 and pump 426 are deactivated. The compressor unit 414 also includes a junction conduit or T-fitting 510 fluidly connecting the tank 430 and the manifold inlet 478, and a transfer conduit or hose 514 (FIG. 13) fluidly connected to the T-fitting 510 for transferring pressurized air from the pump 426 to the tank unit 418 (via the tank 430). In the illustrated construction of the compressor unit 414, the transfer hose 514 is a flexible hose 514 having a male quick-disconnect fitting 518 attached to a distal end of the hose 514. A manually actuated valve 520 (e.g., a ball valve, gate valve, etc.) is connected between the flexible hose 514 and the fitting 518. The valve 520 may be closed when the transfer hose 514 is disconnected from the tank 442 to prevent air in the tank 430 from being discharged to atmosphere. Alternatively, the quick-disconnect fitting 518 on the transfer hose 514 may include an internal check valve (not shown) that is biased closed in the direction of flow through the transfer hose 514 when the motor 422 and pump 426 are activated, thereby inhibiting air in the tank 430 from being discharged through the transfer hose 514 to the atmosphere when the quick-disconnect fitting 518 on the transfer hose 514 is disconnected from the tank unit 418. As a further alternative, the valve 520 may be omitted, and a separate fitting (e.g., an end cap) may be used to close the fitting 518. The quick-disconnect fitting 518 on the transfer hose 514 may alternatively be configured as a female quick-disconnect fitting.

With continued reference to FIG. 13, the compressor unit 414 also includes a pressure relief valve 522 in fluid communication with the tank 430. The pressure relief valve 522 is sized to open at a predetermined pressure to vent pressurized air from the tank 430 until the pressure in the tank 430 falls below the predetermined pressure, at which time the pressure relief valve 522 closes.

Figure 14:
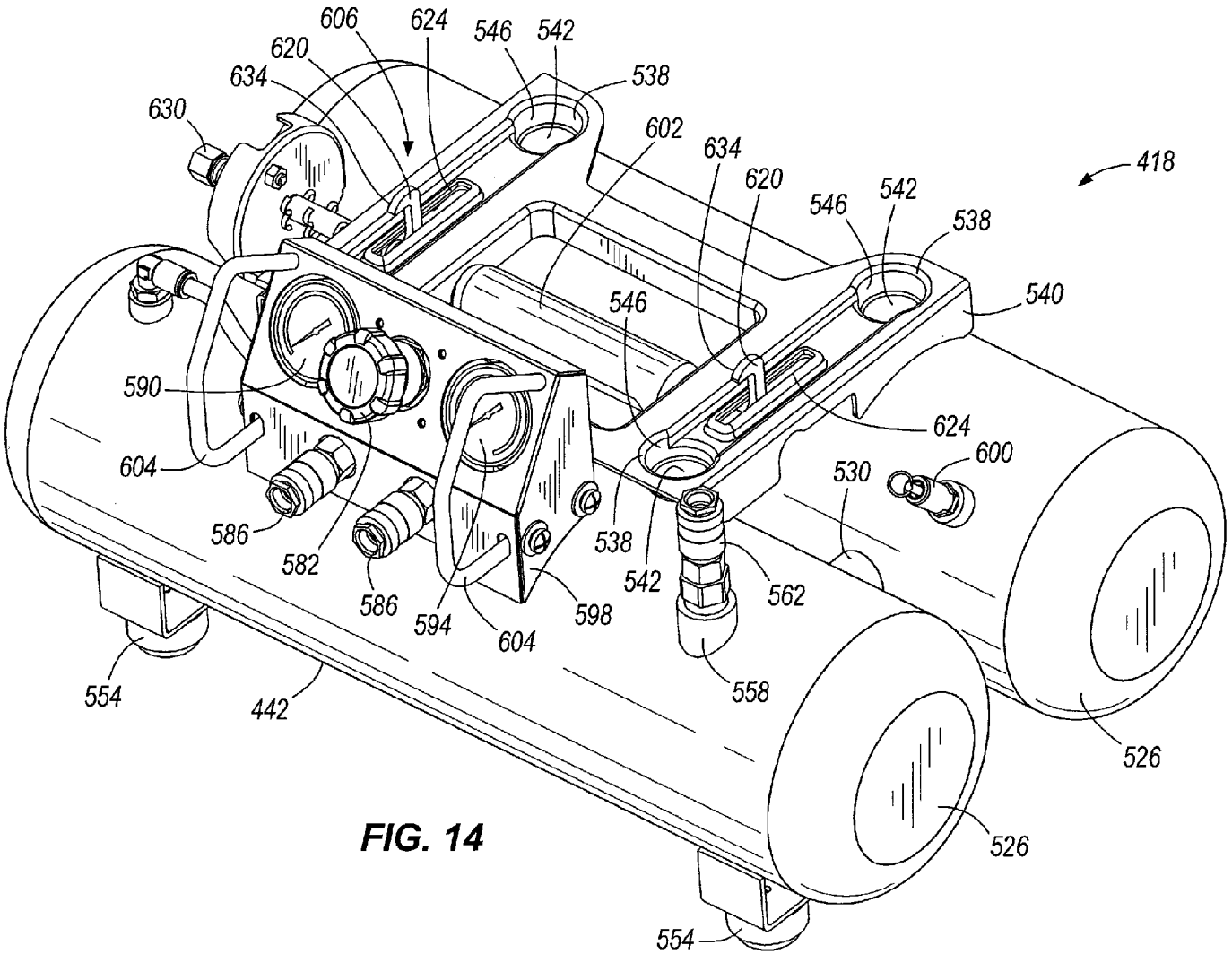
FIG. 14 is a front perspective view of the tank unit of FIG. 11.

With reference to FIG. 14, the tank unit 418 includes the tank 442 (i.e., a "second tank") comprised of two fluidly-interconnected tank portions 526. In the illustrated construction of the tank unit 418, each of the tank portions 526 is cylindrically shaped having an internal volume of about 2 gallons, and a connecting conduit 530 (FIG. 12) is utilized to fluidly connect the two tank portions 526. Thereby, the pressurized air contained within the tank 442 may flow freely between the tank portions 526 via the connecting conduit 530 when the tank 442 is being charged with pressurized air or when pressurized air is discharged from the tank 442. Consequently, the air pressure within each tank portion 526 is equal, and the pressurized air contained within the tank 442 behaves as a single volume of pressurized air rather than discrete volumes of pressurized air. Alternatively, each of the tank portions 526 may have an internal volume of less than or greater than 2 gallons, and the shape of the tank 442 may be configured in any of a number of different ways. For example, the tank 442 may include a single body (e.g., having a "pancake" shape) or the tank 442 may include more than two fluidly-interconnected bodies having any of a number of different shapes.

With continued reference to FIG. 12, the tank unit 418 also includes a drain valve 534 coupled to each of the tank portions 526. Each of the drain valves 534 is positioned near a bottom of the tank portion 526 to facilitate draining any accumulated water in the tank portion 526 that condensed from the pressurized air in the tank 442. The drain valves 534 may be configured as ball valves, gate valves, and the like, and may be selectively opened and closed by the user of the air compressor 410 to drain accumulated water from the tank portions 526.

With reference to FIG. 14, the tank unit 418 includes a plurality of supports 538 coupled (e.g., by welding, etc.) to the tank 442 upon which the elastomeric feet or pads 458 may be positioned for stacking the compressor unit 414 on the tank unit 418. In the illustrated construction of the tank unit 418, the supports 538 are defined in a tray 540 coupled to the tank 442 (e.g., by welding, etc.). Each of the supports 538 includes a support surface 542 and a cylindrical wall 546 surrounding the support surface 542. As shown in FIG. 13, each of the pads 458 includes a reduced-diameter or tapered portion 550 that is received within the space defined by the support surface 542 and the cylindrical wall 546 of each support 138. As such, the support surface 542 of each of the supports 538 directly bears the weight of the compressor unit 414 when the air compressor 410 is sitting stationary on a support surface, while the cylindrical wall 546 of each of the supports 538 provides lateral stability to the compressor unit 414 when it is stacked upon the tank unit 418. Also, as discussed above, the elastomeric pads 458 reduce the amount of vibration transferred from the compressor unit 414 to the tank unit 418, and ultimately to the underlying support surface of the air compressor 410. Alternatively, different structure may be utilized to support the compressor unit 414 on the tank unit 418 in a stacked arrangement.

With reference to FIG. 14, the tank unit 418 also includes a plurality of elastomeric feet or pads 554 disposed at the bottom of the tank 442. Like the elastomeric pads 458 on the compressor unit 414, the elastomeric feet or pads 554 on the tank unit 418 reduce the amount of vibration transferred from the compressor unit 414, through the tank unit 418, and ultimately to the underlying support surface of the air compressor 410.

With continued reference to FIG. 14, the tank unit 418 further includes an inlet 558 through which pressurized air is introduced into the tank 442 and a quick-disconnect fitting 562 fluidly connected to the tank inlet 558. In the illustrated construction of the tank unit 418, the quick-disconnect fitting 562 is configured as a female quick-disconnect fitting 562 having an internal shape corresponding to the male quick-disconnect fitting 518 on the transfer hose 514 of the compressor unit 414. The quick-disconnect fitting 562 on the tank inlet 558 includes an internal check valve 566 (FIG. 21) that is biased closed in a direction opposite the direction of flow through the transfer hose 514 when the motor 422 and pump 426 are activated, thereby inhibiting air in the tank 442 from being discharged to the atmosphere when the transfer hose 514 is disconnected from the tank unit 418. When the respective quick-disconnect fittings 518, 562 are attached, the male quick-disconnect fitting 518 opens the internal check valve 566 in the female quick-disconnect fitting 562. Provided the valve 520 is open, pressurized air from the pump 426 may be transferred through the transfer hose 514, through the valve 520, and into the tank 442.

With reference to FIGS. 21 and 22, the tank unit 418 also includes a manifold 570 having an inlet 574, which is in fluid communication with the tank 442, and an outlet 578. The tank unit 418 further includes a pressure regulator 582 coupled to the manifold 570 between the inlet 574 and the outlet 578. The pressure regulator 582 may be adjusted by the user of the tank unit 418 to restrict the flow of the pressurized air through the manifold 570 and set the output pressure that is available at the outlet 578. More particularly, the pressure regulator 582 may be adjusted between a full-open position, in which the pressure available at the manifold outlet 578 is substantially equal to the pressure in the tank 442, and a partially-opened position, in which the pressure available at the manifold outlet 578 is less than the pressure in the tank 442. As is described in greater detail below, users of the tank unit 418 may adjust the pressure regulator 582 to set the output pressure available at the manifold outlet 578 according to the particular pneumatic tool being used.

The tank unit 418 also includes a plurality of quick-disconnect fittings 586 fluidly connected to the outlet 578 of the manifold 570 to facilitate quick connection with separate air hoses for powering separate pneumatic tools. In the illustrated construction of the tank unit 418, two quick-disconnect fittings 586 are fluidly connected to the manifold outlet 578, and the quick-disconnect fittings 586 are configured as a female quick-disconnect fittings 586 (FIG. 14). Alternatively, the quick-disconnect fittings 586 may be configured as male quick-disconnect fittings.

With continued reference to FIG. 14, the tank unit also includes a pressure gauge 590 fluidly connected to the manifold 570 at a location upstream of the pressure regulator 582 and a pressure gauge 594 fluidly connected to the manifold 570 at a location downstream of the pressure regulator 582. Because the pressure gauge 590 is located upstream of the pressure regulator 582, the pressure gauge 590 (i.e., the "tank" gauge 590) detects the pressure in the tank 442, while the pressure gauge 594 (i.e., the "regulated pressure" gauge 594) located downstream of the pressure regulator 582 detects the available output pressure or regulated pressure at the manifold outlet 578 (FIG. 21). Users of the tank unit 418 may view the tank gauge 590 to determine the air pressure in the tank 442, while the regulated pressure gauge 594 may be viewed by users of the tank unit 418 when adjusting the pressure regulator 582.

The tank unit 418 includes a gauge panel 598 (FIG. 14) supporting the tank gauge 590, the regulated pressure gauge 594, and the pressure regulator 582. In the illustrated construction of the tank unit 418, the gauge panel 598 is coupled to a plurality of upstanding tabs on the tank 442 using a plurality of fasteners (e.g., screws, etc.). Alternatively, the gauge panel 598 may be coupled to the tank 442 in any of the number of different ways. The air compressor 410 also includes a bar 604 on each side of the gauge panel 598. The bars 604 define an outer envelope within which the gauges 590, 594, the pressure regulator 582, and the quick-disconnect fittings 586 are positioned for protection should the air compressor 410 roll over or fall to the ground. Alternatively, each of the bars 604 may be coupled to the tank 442 (e.g., by welding) rather than being coupled to the panel 598.

The tank unit 418 also includes a pressure relief valve 600 in fluid communication with the tank 442. Like the pressure relief valve 522 on the compressor unit 414, the pressure relief valve 600 on the tank unit 418 would be sized to open at a predetermined pressure to vent pressurized air from the tank 442 until the pressure in the tank 442 falls below the predetermined pressure, at which time the pressure relief valve 600 closes.

With reference to FIGS. 14 and 22, the tank unit 418 also includes a handle 602 coupled to the tank 442 (e.g., by welding, etc.) to facilitate hand-carrying the tank unit 418. In the illustrated construction of the air compressor 410, the handle 602 is formed as a single piece with the tray 540 which, in turn, is coupled to the tank 442 (e.g., by welding, etc.). The tray 540 also at least partially supports a locking assembly 606 configured to secure or retain the compressor unit 414 to the tank unit 418 when the compressor unit 414 is stacked upon the tank unit 418. In the illustrated construction of the air compressor 410, the compressor unit 414 includes dual projections 610 that extend substantially parallel with the longitudinal axis 468 (FIG. 22). Particularly, the projections 610 are defined by respective bolts that are fastened to the respective end caps 456, 460 of the motor housing 446. Alternatively, the projections 610 may be integrally formed as one piece with the respective end caps 456, 460 or the drum 452.

With continued reference to FIG. 22, the locking assembly 606 includes a shaft 618 supported for rotation by the tray 540. In the illustrated construction of the air compressor 410, the shaft 618 is received within a bushing (not shown) which, in turn, is positioned within the handle 602. Alternatively, the shaft 618 may be rotatably supported on the tray 540 or the tank 442 in any of a number of different ways. The locking assembly 606 also includes spaced hooks 620 coupled to the shaft 618 for co-rotation with the shaft 618 (e.g., using fasteners, by welding, using a key and keyway arrangement, using a press-fit, etc.). The hooks 620 protrude through respective slots 624 in the tray 540 and are engageable with the respective projections 610 to selectively retain the compressor unit 414 to the tank unit 418.

Figure 15:
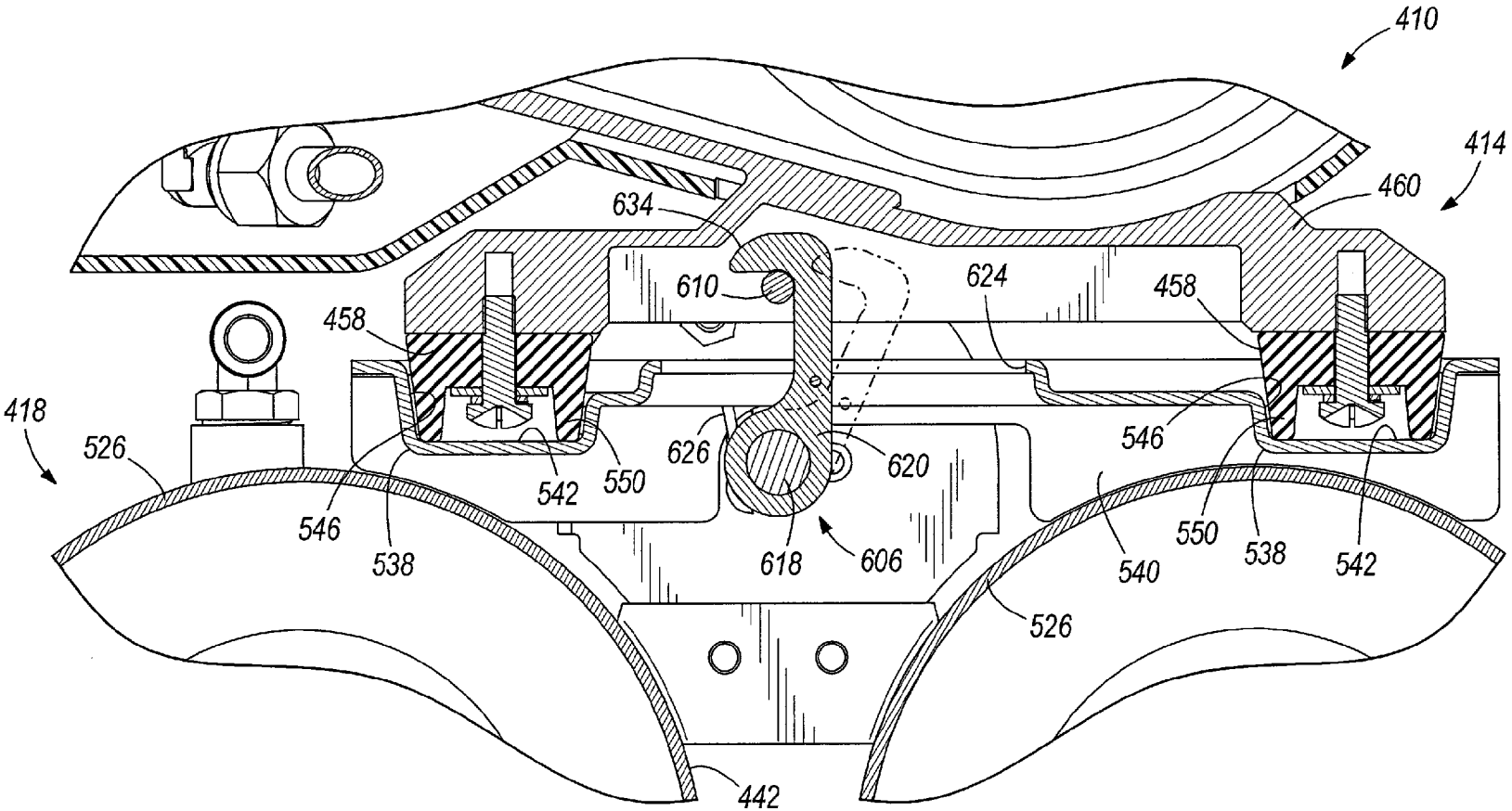
FIG. 15 is a partial cross-sectional view of the air compressor of FIG. 11 illustrating a locking assembly.

With reference to FIG. 15, the shaft 618 and the hooks 620 are rotatable between a first position, in which the hooks 620 engage or latch onto the respective projections 610 to retain the projection 610 to the locking assembly 606 (and therefore retain the compressor unit 414 to the tank unit 418), and a second position (shown in phantom), in which the hooks 620 are spaced or disengaged from the respective projections 610 such that the projections 610 are releasable from the locking assembly 606 (therefore releasing the compressor unit 414 from the tank unit 418). The locking assembly 606 also includes a biasing element (e.g., a torsion spring 626) operable to bias the shaft 618 toward the first position, and an actuator 630 coupled to the shaft 618 (e.g., using clips, fasteners, etc.) for the user of the air compressor 410 to grasp and rotate the shaft 618 against the bias of the torsion spring 626 toward the second position.

When engaged by the locking assembly 606, the compressor unit 414 and the tank unit 418 are transportable together as a unit using the handle 454 of the compressor unit 414. Alternatively, the projections 610 may be incorporated on the tank unit 418, and the locking assembly 606 may be incorporated on the compressor unit 414. As shown in the figures, the structure interconnecting the compressor unit 414 and the tank unit 418 (i.e., the locking assembly 606 and the projections 610) is different than the structure fluidly interconnecting the tanks 430, 442 (i.e., the flexible transfer hose 514). As such, separate actions are required to mechanically interconnect the compressor unit 414 and the tank unit 418, and fluidly interconnect the respective tanks 430, 442 in the compressor and tank units 414, 418.

To disconnect the compressor unit 414 from the tank unit 418, one would first disconnect the transfer hose 514 from the tank unit 418 by disengaging the quick-disconnect fittings 518, 562 (FIG. 11). The user of the air compressor 410 then grasps the actuator 630 and rotates the shaft 618 and the hooks 620 against the bias of the torsion spring 626 to disengage the hooks 620 from the respective projections 610 (FIG. 15). The user of the air compressor 410 then lifts the compressor unit 414 off of the tank unit 418 while holding the shaft 618 in the second position.

To reconnect the compressor unit 414 to the tank unit 418, one would first orient the compressor unit 414 relative to the tank unit 418 such that the front-most elastomeric feet or pads 58 on the compressor unit 414 are generally aligned and positioned within the respective supports 538 on the tank unit 418 (FIGS. 13 and 14). The compressor unit 414 is then lowered onto the tank unit 418 at an angle, causing the projections 610 to engage a curved distal end 634 of the respective hooks 620 which, in turn, causes the shaft 618 to rotate toward the second position against the bias of the torsion spring 626 (FIG. 15). The shaft 618 is then returned to the first position by the torsion spring 626 when the projections 610 are cleared of the hooks 620. As such, the user of the air compressor 410 need not grasp the actuator 630 and rotate the shaft 618 against the bias of the spring 626 when reconnecting the compressor unit 414 to the tank unit 418. Lastly, the transfer hose 514 is reconnected to the tank unit 418 by re-engaging the respective quick-disconnect fittings 518, 562 (FIG. 11). The compressor unit 414 and the tank unit 418 may be disconnected and reconnected in this manner to allow the compressor unit 414 and the tank unit 418 to be carried together as a unit or assembly using only the handle 454 of the compressor unit 414, or to allow the compressor unit 414 and the tank unit 418 to be separately carried using the handles 454, 602 of the respective compressor and tank units 414, 418.

Figure 16:
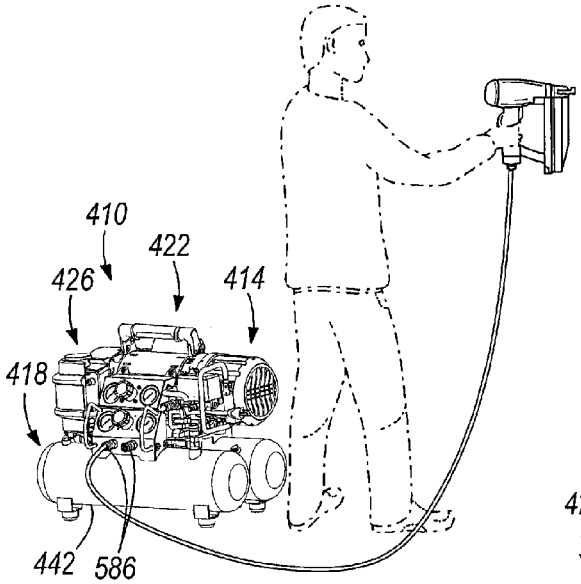
FIG. 16 is a schematic illustrating a first manner of use of the air compressor of FIG. 11.

With reference to FIG. 16, a first manner of using the air compressor 410 is schematically illustrated in which a single user operates a single pneumatic tool using the attached compressor unit 414 and tank unit 418. In this manner, the valve of both tanks 430, 442 would be available to the user, as the tanks 430, 442 are fluidly connected through the check valve 566, which would open to allow pressurized air to transfer from the first tank 430 to the second tank 442 when the motor 422 and pump 426 are activated or deactivated. The user would connect the air hose for the pneumatic tool to one of the quick-disconnect fittings 586 on the tank unit 418 to take advantage of the combined volume of pressurized air stored in the tanks 430, 442 (i.e., 4.5 gallons). For example, frame nailers and floor staplers are pneumatic tools that would typically benefit from the combined volume of pressurized air available in the tanks 430, 442.

Figure 17:
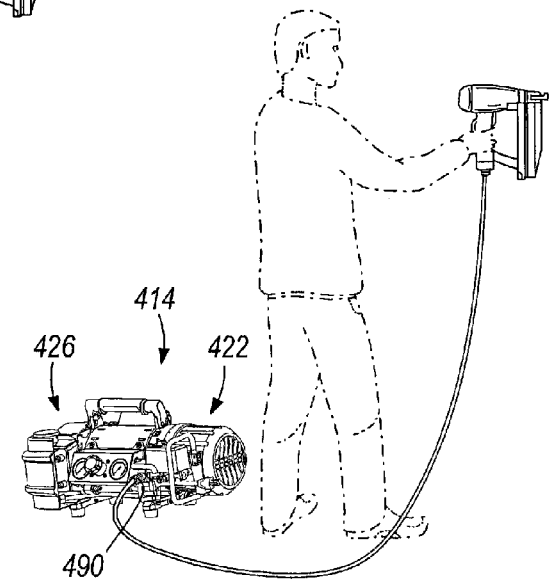
FIG. 17 is a schematic illustrating a second manner of use of the air compressor of FIG. 11.

FIG. 17 illustrates a second manner of operation of the air compressor 410 in which a single operator operates a single pneumatic tool using only the compressor unit 414. In this manner, the user would connect the air hose for the pneumatic tool to the quick-disconnect fitting 490 on the compressor unit 414 to use the pressurized air stored in the tank 430 of the compressor unit 414. This manner of operation may be used with pneumatic tools that require less pressurized airflow for their operation (e.g., trim nailers, finish nailers, etc.). This manner of operation also provides increased mobility to the user, as the tank unit 418 need not be carried with the compressor unit 414 as the user moves about a worksite.

Figure 18:
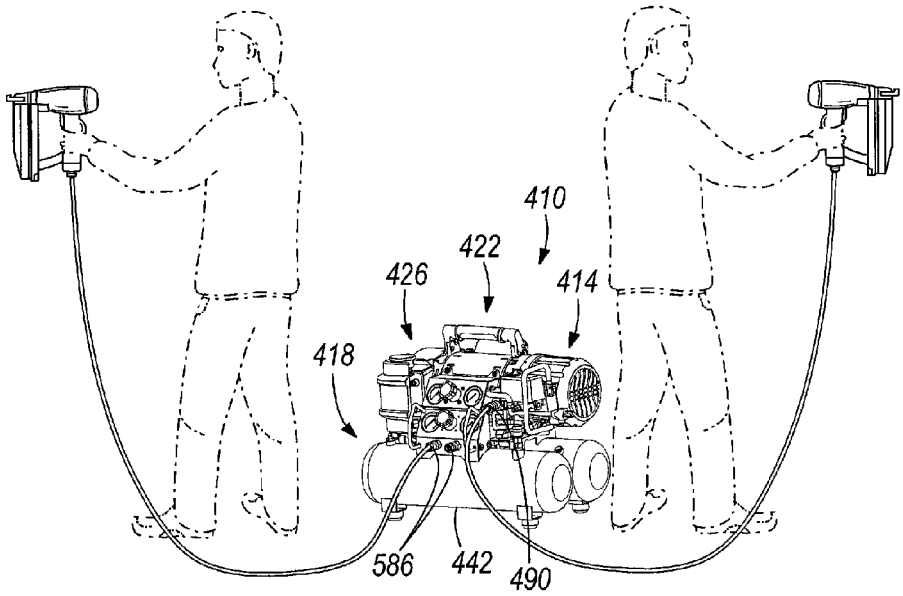
FIG. 18 is a schematic illustrating a third manner of use of the air compressor of FIG. 11.

FIG. 18 illustrates a third manner of operation of the air compressor 410 in which a first user uses the pressurized air stored in the compressor unit 414 to operate a first pneumatic tool (e.g., a trim nailer, finish nailer, etc) and a second user uses the pressurized air stored in the tank unit 418 to operate a second pneumatic tool (e.g., a frame nailer or floor stapler). However, because the tanks 430, 442 are fluidly connected, the pressurized air in the tanks 430, 442 behaves as a single volume. In this manner of operation, the first user would connect the air hose for the first pneumatic tool to the quick-disconnect fitting 490 on the compressor unit 414, and the second user would connect the air hose for the second pneumatic tool to one of the quick-disconnect fittings 586 on the tank unit 418. This manner of operation also allows the first and second users to operate their pneumatic tools at different operating pressures, as the respective pressure regulators 486, 582 in the compressor unit 414 and the tank unit 418 are independently adjustable. For example, the first user might operate the first pneumatic tool at a first regulated pressure (e.g., 80 psi), while the second user might operate the second pneumatic tool at a second regulated pressure that is greater than the first regulated pressure (e.g., 110 psi). Alternatively, a third user may operate a third pneumatic tool fluidly connected to the second quick-disconnect fitting 586 on the tank unit 418. The first and second pneumatic tools may therefore be operated at different regulated pressures because the respective pressure regulators 486, 582 in the compressor unit 414 and the tank unit 418 are independently adjustable.

Figure 19:
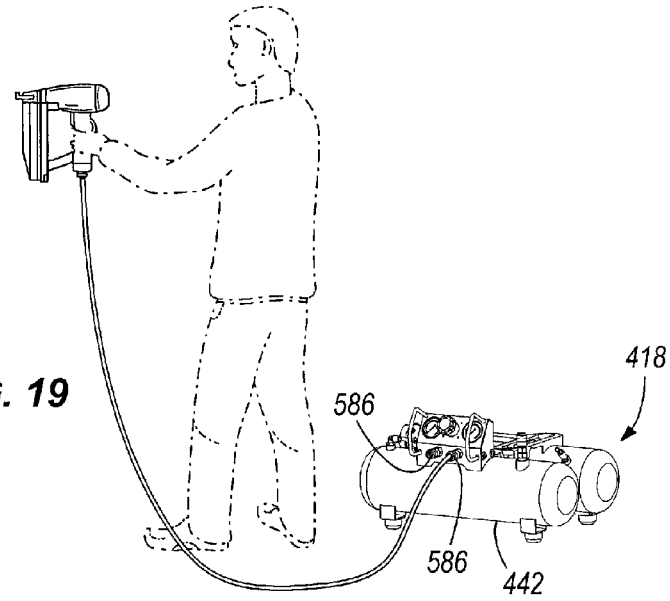
FIG. 19 is a schematic illustrating a fourth manner of use of the air compressor of FIG. 11.

FIG. 19 illustrates a fourth manner of operation of the air compressor 410 in which a single user operates a single pneumatic tool using only the tank unit 418. In this manner, the user would connect the air hose for the pneumatic tool to one of the quick-disconnect fittings 586 on the tank unit 418. This manner of operation provides increased mobility to the user, as the compressor unit 414 need not be carried with the tank unit 418 as the user moves about a worksite. This manner of operation would also allow pneumatic tools requiring higher levels of airflow for their operation (e.g., frame nailers, floor staplers, etc.) to be used in remote locations for a relatively short period of time where portability and mobility are particularly beneficial. Alternatively, a second user may operate a second pneumatic tool fluidly connected to the second quick-disconnect fitting 586 on the tank unit 418.

Figure 20:
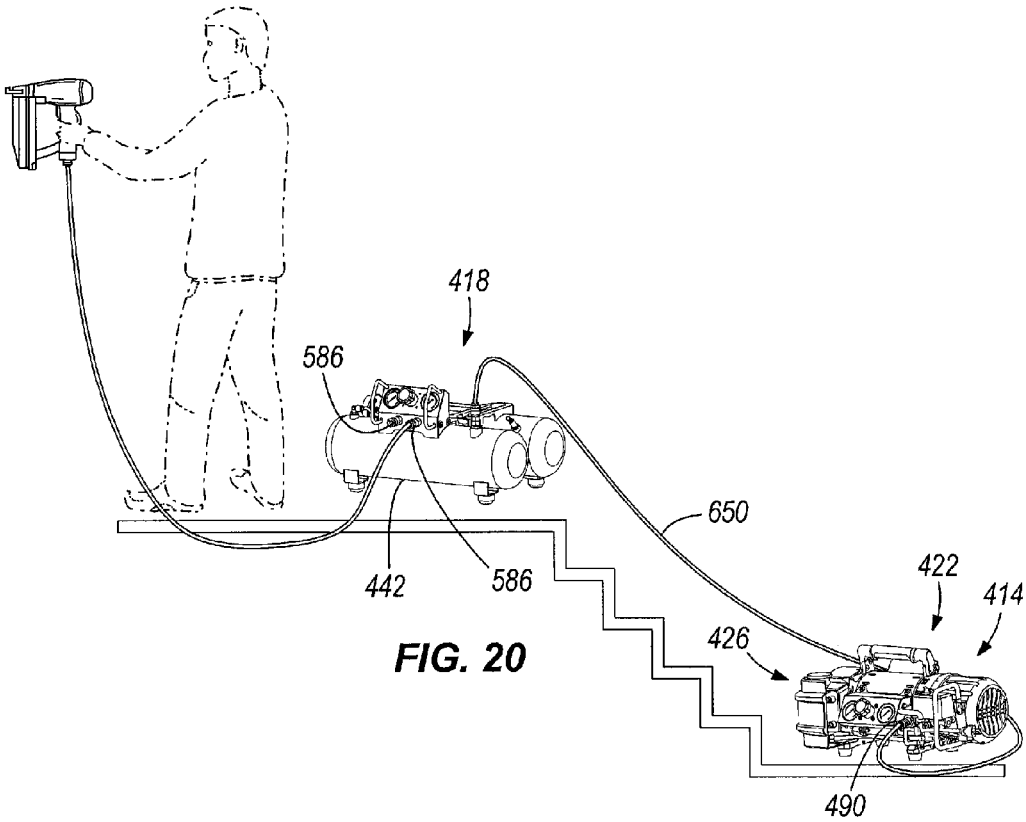
FIG. 20 is a schematic illustrating a fifth manner of use of the air compressor of FIG. 11.

FIG. 20 illustrates a fifth manner of operation of the air compressor 410 in which a single user operates a single pneumatic tool using the tank unit 418 as a "surge tank." In this manner, the user would connect the air hose for the pneumatic tool to one of the quick-disconnect fittings 586 on the tank unit 418. The user would also connect an extended-length transfer hose 650 (e.g., 50 feet) between the transfer hose 514 on the compressor unit 414 and the quick-disconnect fitting 562 on the tank inlet 558 to allow the tank 442 of the tank unit 418 to be filled with compressed air by the pump 426 when the motor 422 and pump 426 are activated. This manner of operation allows pneumatic tools to be used in remote locations, where quiet operation may be particularly beneficial, for long periods of time. Alternatively, a second user may operate a second pneumatic tool fluidly connected to the second quick-disconnect fitting 186 on the tank unit 418.

Various features of the invention are set forth in the following claims.

What is claimed is:

1. An air compressor comprising:

a compressor unit including a motor having a motor housing, a pump operably coupled to the motor, the pump having a pump housing formed as a single piece with a portion of the motor housing, and a first tank fluidly connected to the pump to receive pressurized air from the pump when operated by the motor; and a tank unit removably coupled to the compressor unit in a stacked arrangement, the tank unit including a second tank fluidly connected to the pump to receive pressurized air from the pump when operated by the motor, wherein the motor housing includes opposed end caps, and wherein each end cap includes a leg formed as a single piece therewith, and wherein each of the legs includes a pad at a distal end of the leg, and wherein the tank unit includes a plurality of supports upon which the respective pads are positioned when the tank unit is coupled to the compressor unit in the stacked arrangement.

2. The air compressor of claim 1, further comprising:

a projection extending from one of the compressor unit and the tank unit; and a locking assembly coupled to the other of the compressor and the tank unit, wherein the locking assembly is movable between a first position, in which the projection is retained by the locking assembly, and a second position, in which the projection is releasable from the locking assembly.

3. The air compressor of claim 2, further comprising a handle coupled to at least one of the compressor unit and the tank unit, wherein the compressor unit and the tank unit are transportable together as a unit using the handle when the projection is retained by the locking assembly.

4. The air compressor of claim 1, wherein the compressor unit further includes a first manifold including an inlet in fluid communication with the first tank and an outlet, and a first pressure regulator coupled to the first manifold between the inlet and the outlet, the first pressure regulator operable to reduce the pressure of the pressurized air exiting the first manifold through the outlet.

5. The air compressor of claim 4, wherein the tank unit further includes a second manifold including an inlet in fluid communication with the second tank and an outlet, and a second pressure regulator coupled to the second manifold between the inlet and the outlet of the second manifold, the second pressure regulator operable to reduce the pressure of the pressurized air exiting the second manifold through the outlet of the second manifold.

6. The air compressor of claim 5, wherein the first and second pressure regulators are independently adjustable.

7. The air compressor of claim 1, further comprising a conduit fluidly connecting the first tank and the second tank for transferring pressurized air from the first tank to the second tank during operation of the pump.

8. The air compressor of claim 7, further comprising a quick-disconnect assembly fluidly interconnecting the conduit and at least one of the first tank and the second tank.

9. An air compressor comprising:

a compressor unit including a motor having a motor housing, a pump operably coupled to the motor, and a first tank coaxial with the motor and the pump, the first tank fluidly connected to the pump to receive pressurized air from the pump when operated by the motor; and a tank unit removably coupled to the compressor unit in a stacked arrangement, the tank unit including a second tank fluidly connected to the pump to receive pressurized air from the pump when operated by the motor, wherein the motor housing includes opposed end caps, and wherein each end cap includes a leg formed as a single piece therewith, and wherein each of the legs includes a pad at a distal end of the leg, and wherein the tank unit includes a plurality of supports upon which the respective pads are positioned when the tank unit is coupled to the compressor unit in the stacked arrangement.

10. The air compressor of claim 9, further comprising:

a projection extending from one of the compressor unit and the tank unit; and a locking assembly coupled to the other of the compressor and the tank unit, wherein the locking assembly is movable between a first position, in which the projection is retained by the locking assembly, and a second position, in which the projection is releasable from the locking assembly.

11. The air compressor of claim 10, further comprising a handle coupled to at least one of the compressor unit and the tank unit, wherein the compressor unit and the tank unit are transportable together as a unit using the handle when the projection is retained by the locking assembly.

12. The air compressor of claim 9, wherein the compressor unit further includes a first manifold including an inlet in fluid communication with the first tank and an outlet, and a first pressure regulator coupled to the first manifold between the inlet and the outlet, the first pressure regulator operable to reduce the pressure of the pressurized air exiting the first manifold through the outlet.

13. The air compressor of claim 12, wherein the tank unit further includes a second manifold including an inlet in fluid communication with the second tank and an outlet, and a second pressure regulator coupled to the second manifold between the inlet and the outlet of the second manifold, the second pressure regulator operable to reduce the pressure of the pressurized air exiting the second manifold through the outlet of the second manifold.

14. The air compressor of claim 13, wherein the first and second pressure regulators are independently adjustable.

15. The air compressor of claim 9, further comprising a conduit fluidly connecting the first tank and the second tank for transferring pressurized air from the first tank to the second tank during operation of the pump.

16. The air compressor of claim 15, further comprising a quick-disconnect assembly fluidly interconnecting the conduit and at least one of the first tank and the second tank.

* * * * *